US009911287B2

(12) United States Patent
Takahashi et al.

(10) Patent No.: US 9,911,287 B2
(45) Date of Patent: Mar. 6, 2018

(54) GAME DEVICE, GAME CONTROL METHOD, AND STORAGE MEDIUM STORING A PROGRAM

(71) Applicant: Konami Digital Entertainment, Inc., El Segundo, CA (US)

(72) Inventors: Kazuya Takahashi, Torrance, CA (US); Franklin Kang, Los Angeles, CA (US); Naoki Okada, Redondo Beach, CA (US)

(73) Assignee: Konami Digital Entertainment Co.. LTD., Minato-ku, Tokyo (JP)

( * ) Notice: Subject to any disclaimer, the term of this patent is extended or adjusted under 35 U.S.C. 154(b) by 1128 days.

(21) Appl. No.: 14/090,213

(22) Filed: Nov. 26, 2013

(65) Prior Publication Data

US 2014/0295937 A1 Oct. 2, 2014

Related U.S. Application Data

(60) Provisional application No. 61/806,058, filed on Mar. 28, 2013.

(51) Int. Cl.
*G07F 17/34* (2006.01)
*G07F 17/32* (2006.01)

(52) U.S. Cl.
CPC ..... *G07F 17/34* (2013.01); *G07F 17/326* (2013.01)

(58) Field of Classification Search
CPC ..... G07F 17/34; G07F 17/326; G07F 17/32; G07F 17/3281; G07F 17/3279; A63F 13/80
See application file for complete search history.

(56) References Cited

U.S. PATENT DOCUMENTS 7,371,171 B1 * 5/2008 Englman ..... G07F 17/3244 273/138.2
2005/0187008 A1 * 8/2005 Nakajima ..... G07F 17/32 463/20
2014/0256403 A1 * 9/2014 Caputo ..... G07F 17/3267 463/20
2014/0256409 A1 * 9/2014 Wood ..... G07F 17/326 463/25

FOREIGN PATENT DOCUMENTS

JP 2012-81316 A 4/2012

OTHER PUBLICATIONS

YouTube. (Uploaded on Jul. 10, 2011). Battle Slots PC Gameplay. [Video file]. Retrieved from <URL:https://www.youtube.com/watch?v=cuS8PwNAjFE> (Note: certain screen shots are attached).*

* cited by examiner

*Primary Examiner* — Jasson Yoo
(74) *Attorney, Agent, or Firm* — Sughrue Mion, PLLC

(57) ABSTRACT

A game device includes a first setting unit, a lottery unit, a decision unit, and a determination unit. The first setting unit sets a first character for a first player and a second character different from the first character, both belonging to a first group. The lottery unit decides stop positions of spinning slot reels of a reel group displayed on a display. The decision unit decides a battle action of the first group. The determination unit decreases hit points of an enemy character in response to the battle action and decreases hit points of at least one of the first and second characters in response to another battle action by the enemy character, so as to determine a winner based on respective remaining amounts of the hit points.

9 Claims, 21 Drawing Sheets

| FITTED GEAR | STICK | - | STEEL ARMOR | ·· |
|---|---|---|---|---|
| MAGICAL DEFENSIVE STRENGTH | 21 | 12 | 3 | ·· |
| DEFENSIVE STRENGTH | 25 | 15 | 18 | ·· |
| MAGICAL ATTACK POWER | 31 | 15 | 2 | ·· |
| ATTACK POWER | 15 | 16 | 21 | ·· |
| EXPERIENCE POINTS | 35 | 15 | 23 | ·· |
| SECOND GROUP TO WHICH THE CHARACTER BELONGS | LIGHT | DARKNESS | LIGHT | ·· |
| CHARACTER IMAGE | IM001 | IM002 | IM003 | ·· |
| PLAYER ID | #001 | #002 | #003 | ·· |
| PLAYER NAME | OO | ΔΔ | ×× | ·· |

*FIG. 4*

| FITTED GEAR | STICK | – | STEEL ARMOR | · · |
|---|---|---|---|---|
| MAGICAL DEFENSIVE STRENGTH | 21 | 12 | 3 | · · |
| DEFENSIVE STRENGTH | 25 | 15 | 18 | · · |
| MAGICAL ATTACK POWER | 31 | 15 | 2 | · · |
| ATTACK POWER | 15 | 16 | 21 | · · |
| EXPERIENCE POINTS | 35 | 15 | 23 | · · |
| SECOND GROUP TO WHICH THE CHARACTER BELONGS | LIGHT | DARKNESS | LIGHT | · · |
| CHARACTER IMAGE | IM001 | IM002 | IM003 | · · |
| PLAYER ID | #001 | #002 | #003 | · · |
| PLAYER NAME | ○○ | △△ | ×× | · · |

GAME DEVICE, GAME CONTROL METHOD, AND STORAGE MEDIUM STORING A PROGRAM

CROSS-REFERENCE TO RELATED APPLICATION

This application claims the benefit of U.S. Provisional Application No. 61/806,058, filed Mar. 28, 2013.

BACKGROUND OF THE INVENTION

Field of the Invention

This disclosure of the present invention relates to a game device, a game control method, and a storage medium storing a program.

Description of the Related Art

Japanese Laid-open Patent Publication No. 2012-081316 discloses a known game device configured to provide a game in which characters battle with one another. This game device is configured to judge, under a prescribed relative advantage determining rule, the relative advantage between slot game patterns associated with the character on one side and the slot game patterns associated with the character on the other side, and to control, based on the relative advantage judgment, the attacking authority of the character on one side and the character on the other side to perform attacking control. This game device is also configured to determine the tricks used by the character on one side and the tricks used by the character on the other side, based on the slot game patterns associated with the respective characters.

SUMMARY

In some aspects of the invention, a game device may include, but is not limited to, a first setting unit, a lottery unit, a decision unit, and a determination unit. The first setting unit may be configured to set a first character for a first player and a second character different from the first character, both the first and second characters belonging to a first group. The lottery unit may be configured to decide stop positions of spinning slot reels displayed on a display. The decision unit may be configured to decide a battle action of the first group, with reference to the stop positions of the spinning slot reels of the first reel group decided by the lottery unit, and on the basis of symbols to be stopped at the stop positions and on the basis of parameters of the first and second characters. The determination unit may be configured to decrease hit points of an enemy character in response to the battle action of the first group decided by the decision unit. The determination unit may be configured to decrease hit points of at least one of the first and second characters belonging to the first group in response to another battle action by the enemy character. The determination unit may also be configured to determine a winner based on respective remaining amounts of the hit points of the at least one of the first and second characters and the enemy character.

In other aspects of the present invention, a computer-implemented game control method may include, but is not limited to, the following processes. The method may include a process for setting a first character for a first player and a second character different from the first character, both the first and second characters belonging to a first group. The method may also include a process for deciding stop positions of spinning slot reels displayed on a display. The method may also include a process for deciding a battle action of the first group, with reference to the stop positions of the spinning slot reels of the first reel group decided, and on the basis of symbols to be stopped at the stop positions and on the basis of parameters of the first and second characters. The method may also include a process for decreasing hit points of an enemy character in response to the battle action of the first group decided. The method may also include a process for decreasing hit points of at least one of the first and second characters belonging to the first group in response to another battle action by the enemy character. The method may also include a process for determining a winner based on respective remaining amounts of the hit points of the at least one of the first and second characters and the enemy character.

In other aspects of the present invention, a non-transitory computer readable medium stores a computer program to be executed by a computer to perform a game control method. The method may include, but is not limited to, the following processes. The method may include a process for setting a first character for a first player and a second character different from the first character, both the first and second characters belonging to a first group. The method may also include a process for deciding stop positions of spinning slot reels displayed on a display. The method may also include a process for deciding a battle action of the first group, with reference to the stop positions of the spinning slot reels of the first reel group decided, and on the basis of symbols to be stopped at the stop positions and on the basis of parameters of the first and second characters. The method may also include a process for decreasing hit points of an enemy character in response to the battle action of the first group decided. The method may also include a process for decreasing hit points of at least one of the first and second characters belonging to the first group in response to another battle action by the enemy character. The method may also include a process for determining a winner based on respective remaining amounts of the hit points of the at least one of the first and second characters and the enemy character.

BRIEF DESCRIPTION OF THE DRAWINGS

The above features and advantages of the present invention will be more apparent from the following description of certain preferred embodiments taken in conjunction with the accompanying drawings, in which:

FIG. 4 is a view of a table of character-related data stored in a storage unit in the game server of FIG. 3;

DETAILED DESCRIPTION OF THE PREFERRED EMBODIMENTS

Embodiments of the invention will be now described herein with reference to illustrative embodiments. Those skilled in the art will recognize that many alternative embodiments can be accomplished using the teaching of the embodiments of the present invention and that the invention is not limited to the embodiments illustrated for explanatory purpose.

[Configuration]

Figure 1:
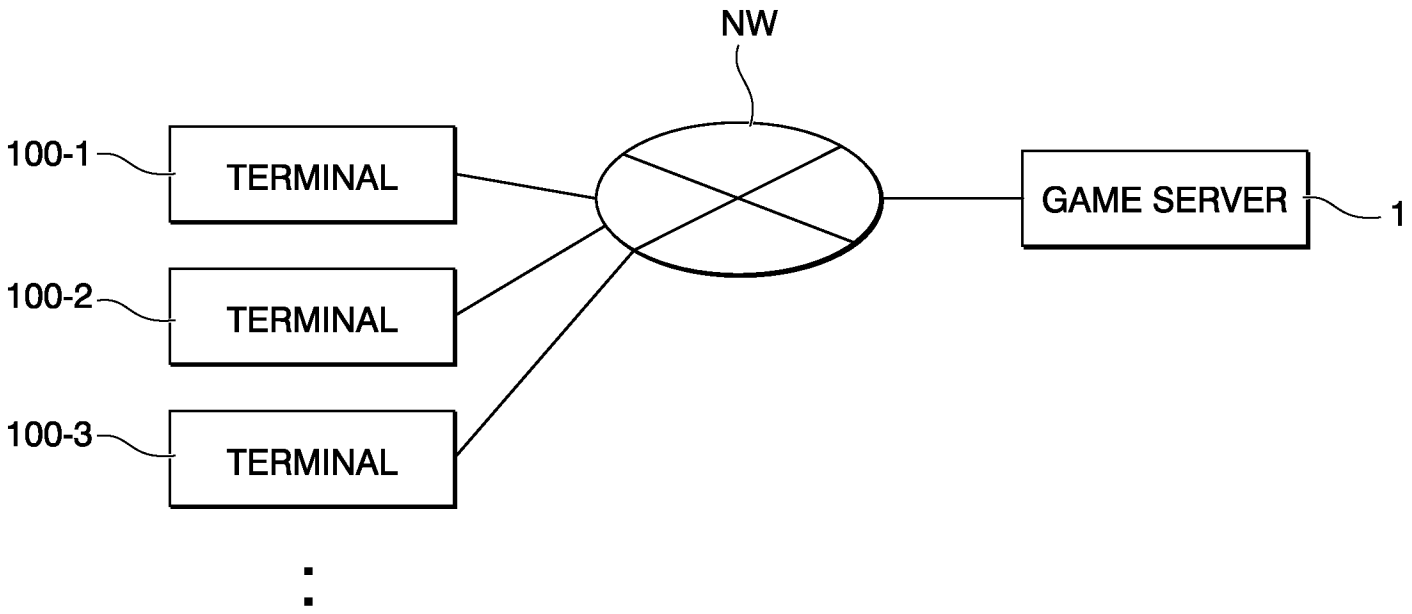
FIG. 1 is a view of a system for providing a computer-implemented game in accordance with a first preferred embodiment of the present invention.
Figure 2:
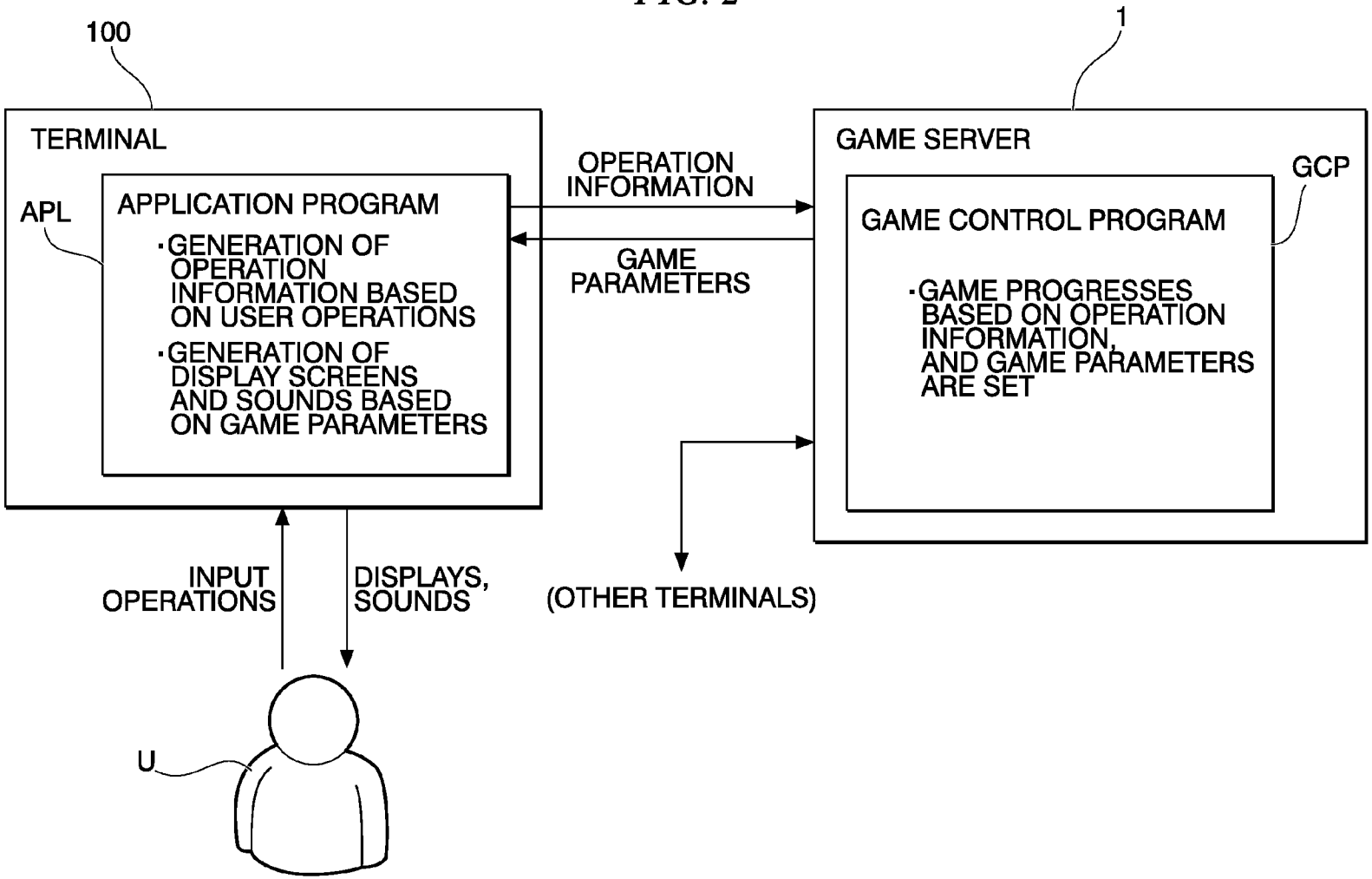
FIG. 2 is a view of assigned main roles to be played by a terminal and a game server included in the system of FIG. 1.

FIG. 1 shows the environment in which the game is provided in the present embodiment. FIG. 2 shows in schematic form the division of roles when the game of the present embodiment is provided. Terminals 100-1, 100-2, . . . (up to an arbitrary number) have, for example, touch panels. A user U (player) inputs operations with respect to the game. In the following, when not distinguishing with respect to any particular terminal, the terminal will be referred to simply as the terminal 100. A CPU (central processing unit) or the like executes an application program APL in a terminal 100. In the game server 1, a CPU or the like executes a game control program GCP.

The application program APL generates operation information based on input operations made by a user U (player) of the terminal 100, and transmits the operation information to the game server 1 via a non-illustrated communication unit. The game control program GCP progresses through the game based on the operation information received from the terminal 100, and generates and transmits to the terminal 100 games parameters based on the progression results. Upon receiving the game parameters from the game server 1, at the terminal 100 the application program APL generates and outputs to the user U (player) display images and sounds, based on the game parameters. This division of roles is merely one example, and the data for displayed images (including data for rendering and image data itself) may be generated in the game server 1, and more processing may be done in the terminal 100. Also, the configuration may be one in which the terminal 100 does all the processing, and the network NW and the game server 1 are not required.

The network NW is an information communication network, such as a mobile telephone network, a PHS (Personal Handy-Phone System) network, a VPN (virtual private network), a dedicated communication circuit network, a WAN (wide area network), a LAN (local area network), a PSTN (public switched telephone network), or a combination thereof.

Figure 3:
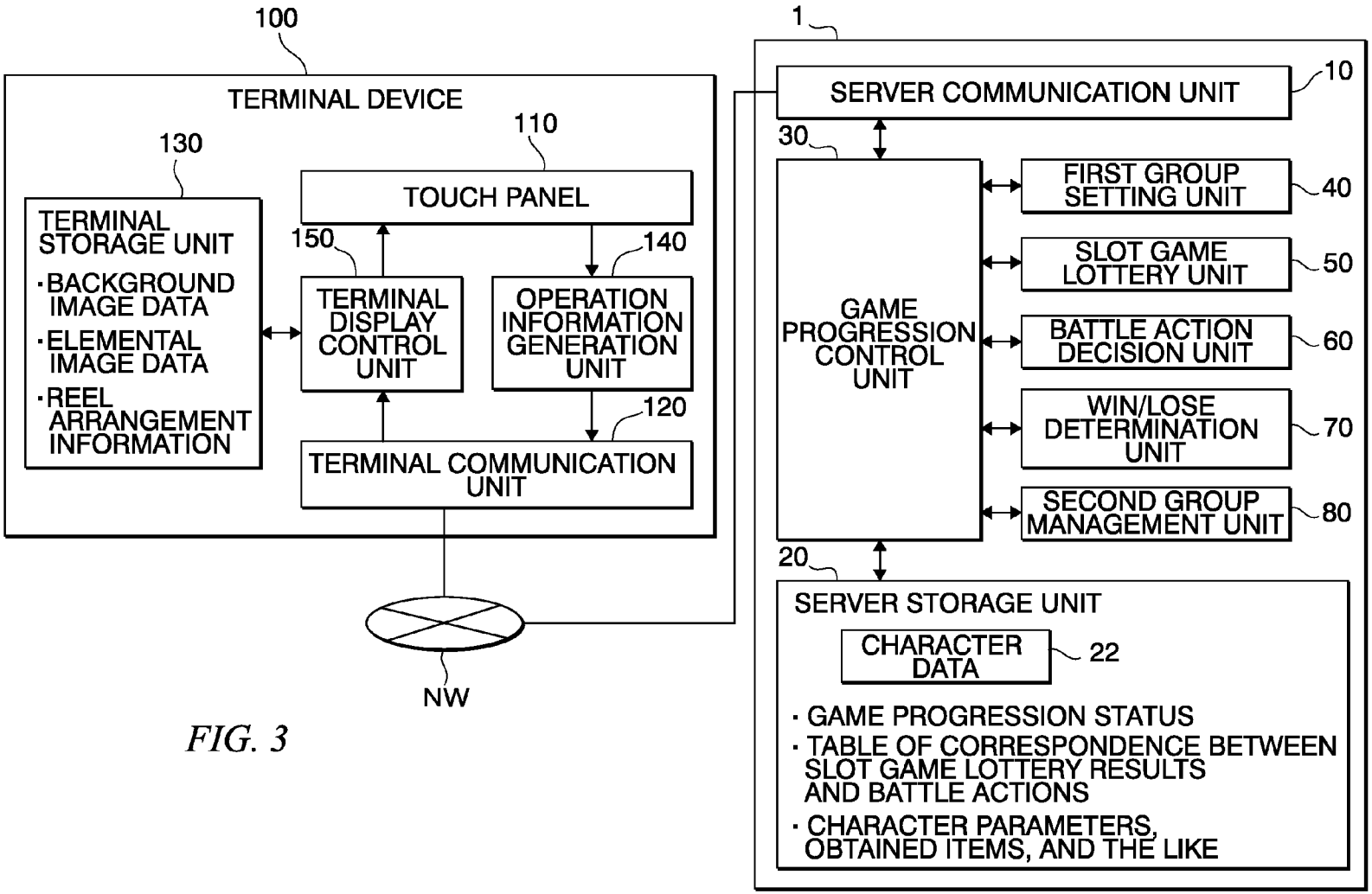
FIG. 3 is a view of configurations of a terminal and a game server included in the system of FIG. 1.

FIG. 3 shows an example of a configuration of the game server 1 and the terminal 100 of the present embodiment. The terminal 100 will be described first. The terminal 100 is a terminal used by a player, for example, a mobile telephone or tablet terminal, a personal computer, or a dedicated game console or the like. The terminal 100 has, for example, a touch panel 110, a terminal communication unit 120, a terminal storage unit 130, an operation information generation unit 140, and a terminal display control unit 150.

The touch panel 110 of the terminal 100 is configured, for example, by liquid crystal display device or an organic EL (electroluminescence) display device, which is overlaid with a contact sensing mechanism that senses contact by a player, using a capacitive method, a resistive film method, an infrared method, a surface acoustic wave method, or the like. The terminal 100 may have, in place of (or in addition to) the contact sensing mechanism of the touch panel 110, a different type of input device (such as a button, a key, a mouse, or a touch pad).

The terminal communication unit 120 is configured to communicate with a server communication unit 10 of the game server 1, via the network NW. The terminal storage unit 130 is configured to store, in addition to storing the above-noted application program APL, for example, results of various processing in the terminal 100. The operation information generation unit 140 and the terminal display control unit 150 are software functional units that, for example, are configured to function by the CPU of the terminal 100 executing the application program APL. The operation information generation unit 140 is configured to interpret an operation made by a player on the touch panel 110, and transmits the operation information to the game server 1. The terminal display control unit 150 is configured to generate display images, based on game parameters received by the terminal communication unit 120 from the game server 1, and to display the same on the touch panel 110.

The game server 1 includes, for example, a server communication unit 10, a server storage unit 20, a game progression control unit 30, a first group setting unit 40, a slot game lottery unit 50, a battle action decision unit 60, a win/lose determination unit 70, and a second group management unit 80. The game progression control unit 30, the slot game lottery unit 50, the battle action decision unit 60, the win/lose determination unit 70, and the second group management unit 80 are, for example, software functional units that function by the CPU of the game server 1 executing the game control program GCP. The server communication unit 10 is configured to communicate with the terminal communication unit 120 of the terminal 100, via the network NW. The server storage unit 20 is configured to store, in addition to storing the above-noted game control program GCP, for example, results of various processing in the game server 1.

Character data 22 is data that codes, for each player character playing the game, the group (second group) to which the character belongs and parameters and the like. FIG. 4 shows an example of character data stored as character data 22 in the server storage unit 20. The names of players operating each character (that is, the character names), player IDs, which are information identifying players, character images (or image identifying information), the second group of membership, and experience points, attack power, magical attack power, defensive strength, and fitted gear, which are character parameters are stored in the character data 22. In the game of the present embodiment, "character" is not limited to be a character visualized by a character image, but may also be a character having only a name and parameters, but does not have a character image that appears on the screen. The server storage unit 20 may be a database server that is separate from the game server 1.

The game progression control unit 30 is configured to perform overall control of the game provided in terminal 100, to generate game parameters, and to control the server communication unit 10 so as to transmit the generated game parameters to the terminal 100.

The first group setting unit 40 is configured to set the player character and the party (first group) that accompanies the player character on an adventure. In the present embodiment, the first group is made up of three characters, including one player character and two other characters. Of these three characters, the player character is called the first character, and the other characters are called the second character and the third character. The second character and the third character are, for example, characters with which other players have played the game as their characters. The parameters of the second character and the third character are parameters that reflect the results of games played by the "other players" on their own. As a result of this relationship, players can borrow each other's characters in setting the first group and play the game with the first group has the player own character group.

Figure 5:
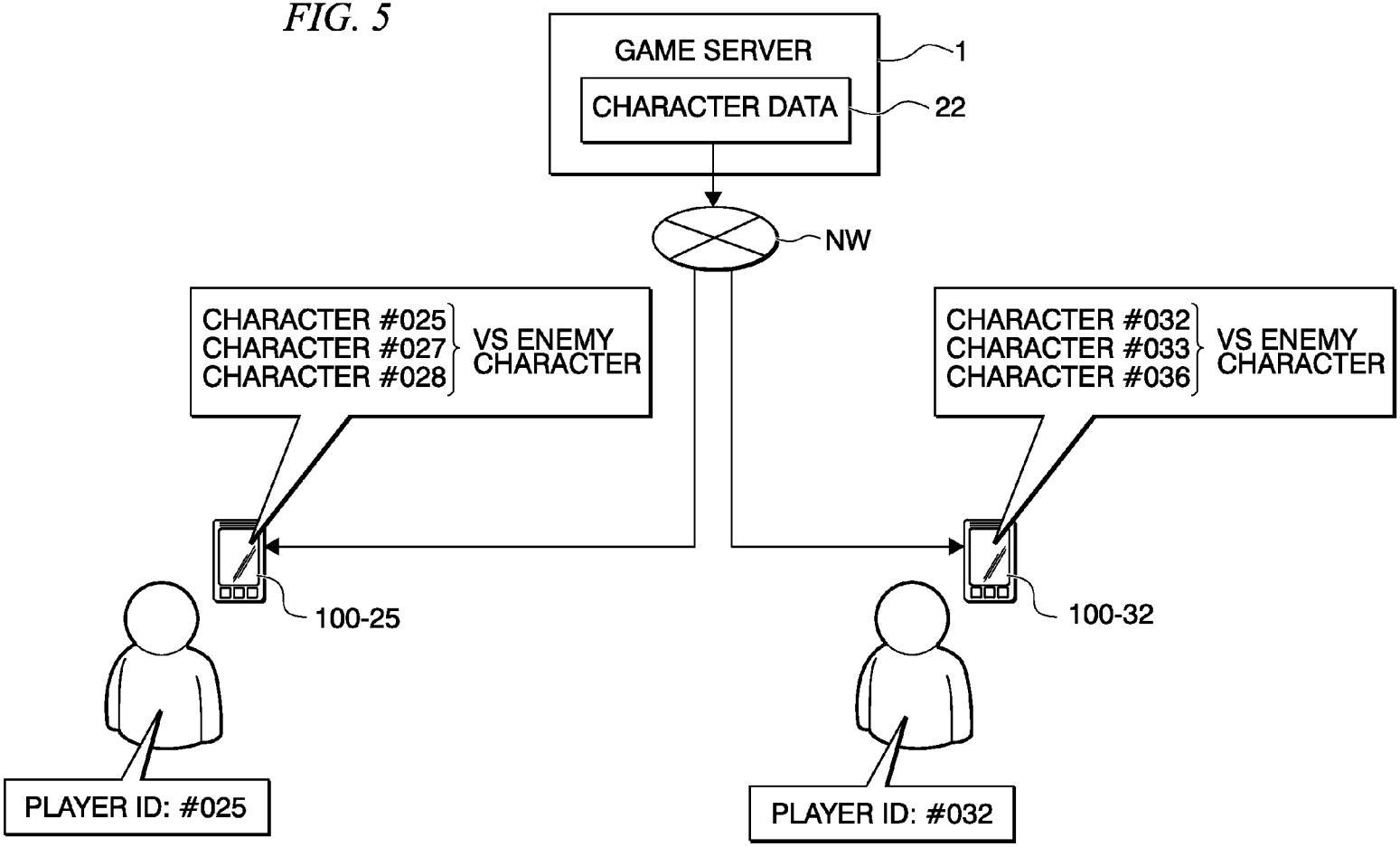
FIG. 5 is a schematic view of a mode of using characters in a game provided by the system of FIG. 3.

FIG. 5 shows, in schematic form, the method of using characters. In FIG. 5, the player with the player ID #025 and using terminal 100-25 to play the game, in addition to the player own character, adds the character of the player with the player ID #027 and the character of the player with the player ID #028 to the first group, and plays a battle game with the enemy character. The player with the player ID #032 and using terminal 100-32 to play the game, in addition to the player own character, adds the character of the player with the player ID #033 and the character of the player with the player ID #036 to the first group, and plays a battle game with the enemy character. The game of the present embodiment enables, for example, by these relationships, friends to enjoy loaning each other their own developed characters. By doing this, communication regarding the game occurs, thereby enabling a broadening of the enjoyment of the game. Additionally, in the game of the present embodiment, because a player can have his or her character used by another player, it is possible to impart to a player the motivation to build the strength of his or her character, thereby evoking the desire to play the game.

The slot game lottery unit 50 is configured to perform lottery regarding the slot game executed within the game, and to decide the stopping positions of the slot reels. The battle action decision unit 60 is configured to decide the battle action of enemy-side character (hereinafter referred to as an "enemy character"), based on the parameters of the characters belonging to the first group. The win/lose determination unit 70 is configured to calculate the variable amount of hit points of each character, in accordance with the parameters of the characters belonging to the first group, the battle actions of the characters belonging to the first group, and the battle action of the enemy character. The win/lose determination unit 70 is configured to determine a winner based on the remaining amount of those hit points. More specifically, the win/lose determination unit 70 is configured to decrease the hit points of the enemy character in response to the battle actions of the first group, and to decrease the hit points of the characters of the first group in response to the battle action of the enemy character. The enemy character is, for example, an NPC (non-player character) controlled by a CPU of the game server 1 or the terminal 100.

The second group management unit 80 is configured to add to the character data 22 information indicating that the character of each player belongs to which group of a plurality of second groups. The second group management unit 80 is configured to accumulate the points acquired reflecting the results of the game, for each second group, and to transmit and display the results of the accumulation at each of the terminals device 100 as game parameters.

The terminal storage unit 130 is configured to store, for example, background image data of each mode of the game and elemental image data (image data for characters, slot reel symbols, display parameters, and items), and reel symbol arrangement information and the like. The server storage unit 20 is configured to store, in addition to the character data 22, for example, data indicating the progression status of the game, reel symbol arrangement information, a table of correspondence between slot game lottery results and battle actions, character parameters, and obtained items. The terminal display control unit 150 is configured to generate, for example, game images by embedding elemental image data into the background data, in accordance with the progression status of the game indicated by the game parameters. The terminal display control unit 150 may alternatively be configured to perform rendering and to display images based on data for image rendering received from the game server 1, and to display image data received from the game server 1. The terminal storage unit 130 and server storage unit 20 may be configured to redundantly store various data.

[Game Progression (First Mode)]

FIG. 6 to FIG. 16 show an example of the transition of the screens up until reaching the "slot game battle" in the game of the present embodiment. The terminal display control unit 150 of the terminal 100 is configured to display screens on the touch panel 110, based on data indicating the game progression status that is included in the game parameters received from the game server 1.

Figure 6:
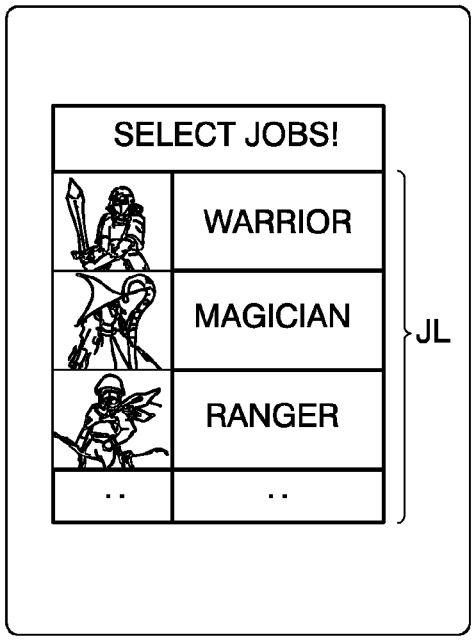
FIG. 6 is a view of an image displayed on a display screen of the terminal of FIG. 3 in a step involved in a transition until reaching a "slot game battle" in the game provided by the system of FIG. 3.

In the screen shown in FIG. 6, the player selects the job of his or her own character from jobs such as warrior, magician, ranger, and the like displayed in the job list JL. The lottery operation is performed, for example, by the player touching the part of the touch panel 110 on which the job list JL is displayed, and then tapping a non-illustrated verification button. When this operation is made, the operation information generation unit 140 of the terminal 100 generates and transmits to the game server 1 operation information responsive to the operation. The game progression control unit 30 of the game server 1, in response to the received operation information, updates the game progression status and transmits game parameters indicating the game progression status to the terminal 100. The terminal 100 causes display on the touch panel 110 of a screen responsive to game parameters indicating the immediately previously received game progression status. Thereafter, the same type of processing is performed in accordance with a variety of operational information.

Figure 7:
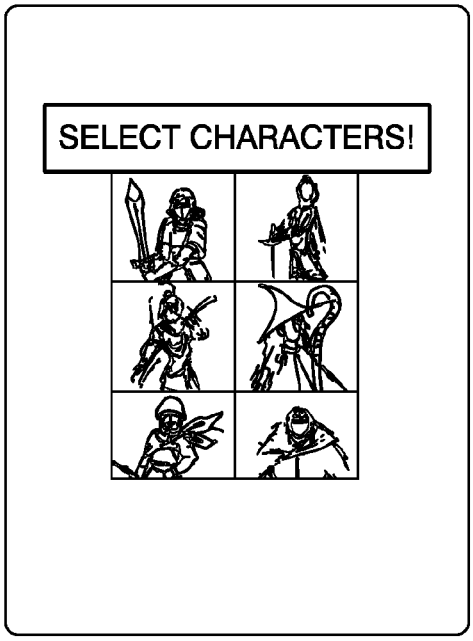
FIG. 7 is a view of an image displayed on the display screen of the terminal of FIG. 3 in a step, subsequent to the step of FIG. 6, involved in the transition until reaching the "slot game battle" in the game provided by the system of FIG. 3.
Figure 8:
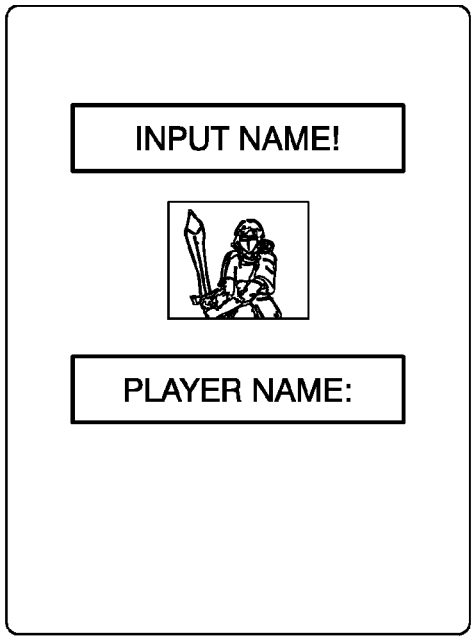
FIG. 8 is a view of an image displayed on the display screen of the terminal of FIG. 3 in a step, subsequent to the step of FIG. 7, involved in the transition until reaching the "slot game battle" in the game provided by the system of FIG. 3.
Figure 9:
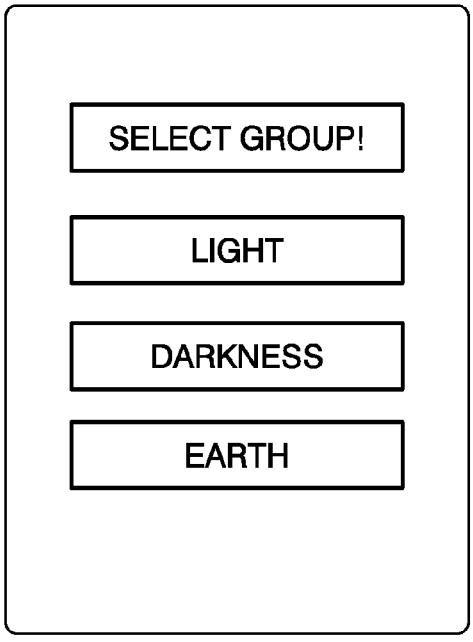
FIG. 9 is a view of an image displayed on the display screen of the terminal of FIG. 3 in a step, subsequent to the step of FIG. 8, involved in the transition until reaching the "slot game battle" in the game provided by the system of FIG. 3.

Next, in the screen shown in FIG. 7, the player selects a character according to the selected job. Next, in the screen shown in FIG. 8, the player sets the name of his or her character. Next, in the screen shown in FIG. 9, the player selects the second group to which his or her character will belong. The second groups are expressed by names such as Darkness and Earth.

Figure 10:
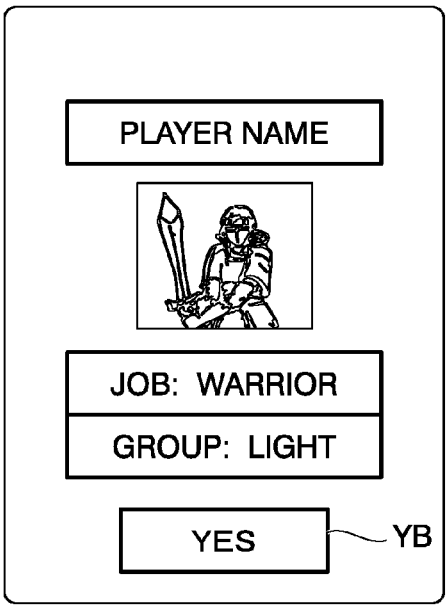
FIG. 10 is a view of an image displayed on the display screen of the terminal of FIG. 3 in a step, subsequent to the step of FIG. 9, involved in the transition until reaching the "slot game battle" in the game provided by the system of FIG. 3.
Figure 11:
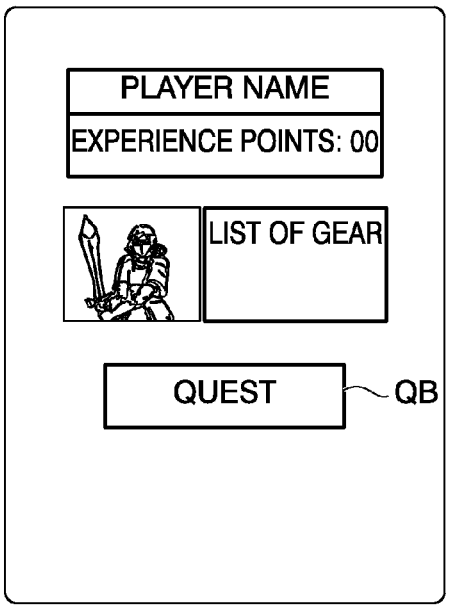
FIG. 11 is a view of an image displayed on the display screen of the terminal of FIG. 3 in a step, subsequent to the step of FIG. 10, involved in the transition until reaching the "slot game battle" in the game provided by the system of FIG. 3.
Figure 12:
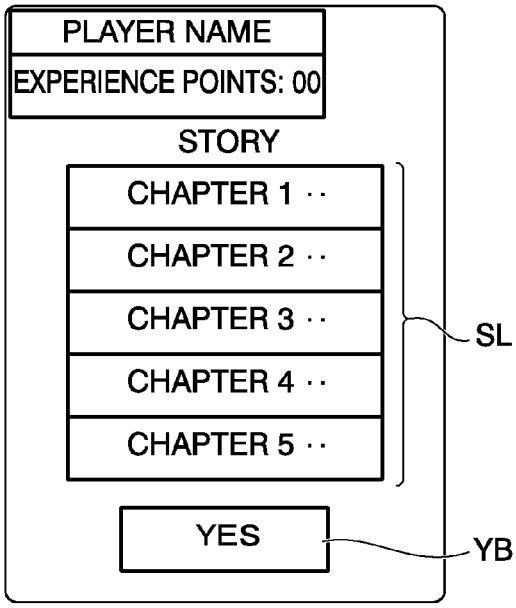
FIG. 12 is a view of an image displayed on the display screen of the terminal of FIG. 3 in a step, subsequent to the step of FIG. 11, involved in the transition until reaching the "slot game battle" in the game provided by the system of FIG. 3.
Figure 13:
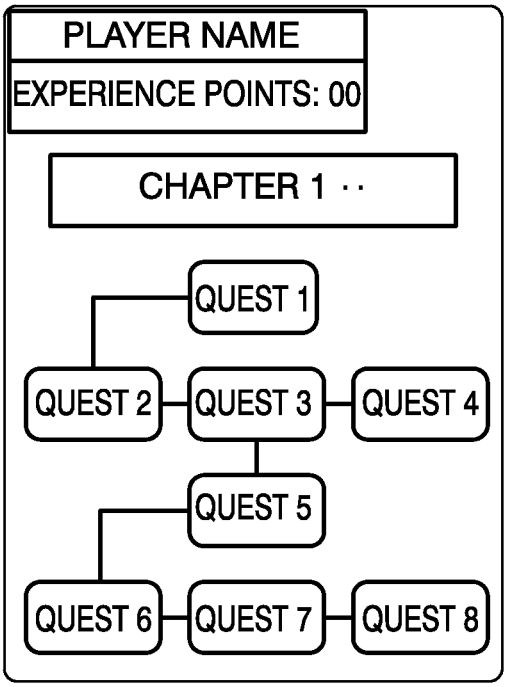
FIG. 13 is a view of an image displayed on the display screen of the terminal of FIG. 3 in a step, subsequent to the step of FIG. 12, involved in the transition until reaching the "slot game battle" in the game provided by the system of FIG. 3.
Figure 14:
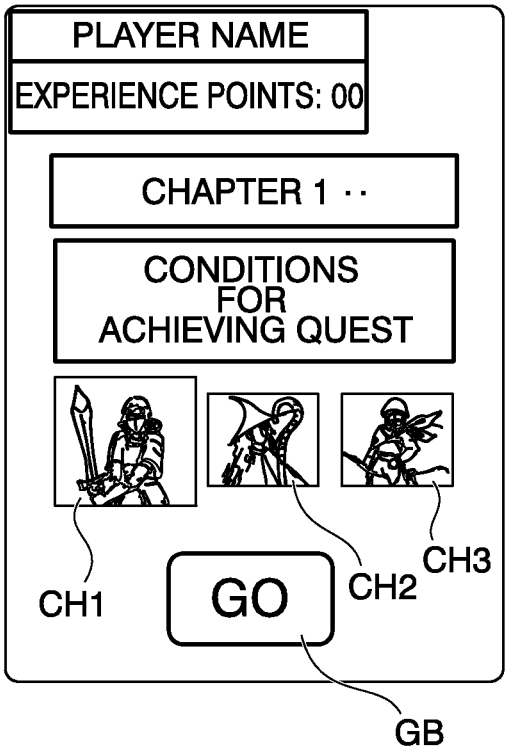
FIG. 14 is a view of an image displayed on the display screen of the terminal of FIG. 3 in a step, subsequent to the step of FIG. 13, involved in the transition until reaching the "slot game battle" in the game provided by the system of FIG. 3.

When these lotteries and settings are completed, in the screen shown in FIG. 10, a final verification is made of the details of the lotteries and settings. In the drawing, when the YES button YB is operated, it is judged that final acknowledgment has been made. Next, the home screen shown in FIG. 11 is displayed. If a player is playing the game for a second or subsequent time, the home screen shown in FIG. 11 may be displayed at first. In the home screen shown in FIG. 11, the player may select various actions, and cause progression of the game. For example, by operating the Quest button QB, the player can transition to the story selection screen shown in FIG. 12. In the screen shown in FIG. 12, the player selects a story from the story list SL and, by operating the YES button YB, finalizes the selection of the story. Additionally, in the screen shown in FIG. 13, the player selects the quest that he or she is about to attempt to achieve. When the quest is selected, in the screen shown in FIG. 14, along with the first character CH1, the second and third characters CH2 and CH3 which are joined into the first group and accompany in the adventure are displayed, and the conditions for achieving the quest and the like are explained. The second and third characters CH2 and CH3 are, for example, carried over from settings made by the player on the last play. If the player is playing the game for the first time, the player may select the second and third characters CH2 and CH23 from the screen of FIG. 26 and the like, which will be described later. In the screen shown in FIG. 14, when the GO button GB is operated, the first mode starts.

Figure 15:
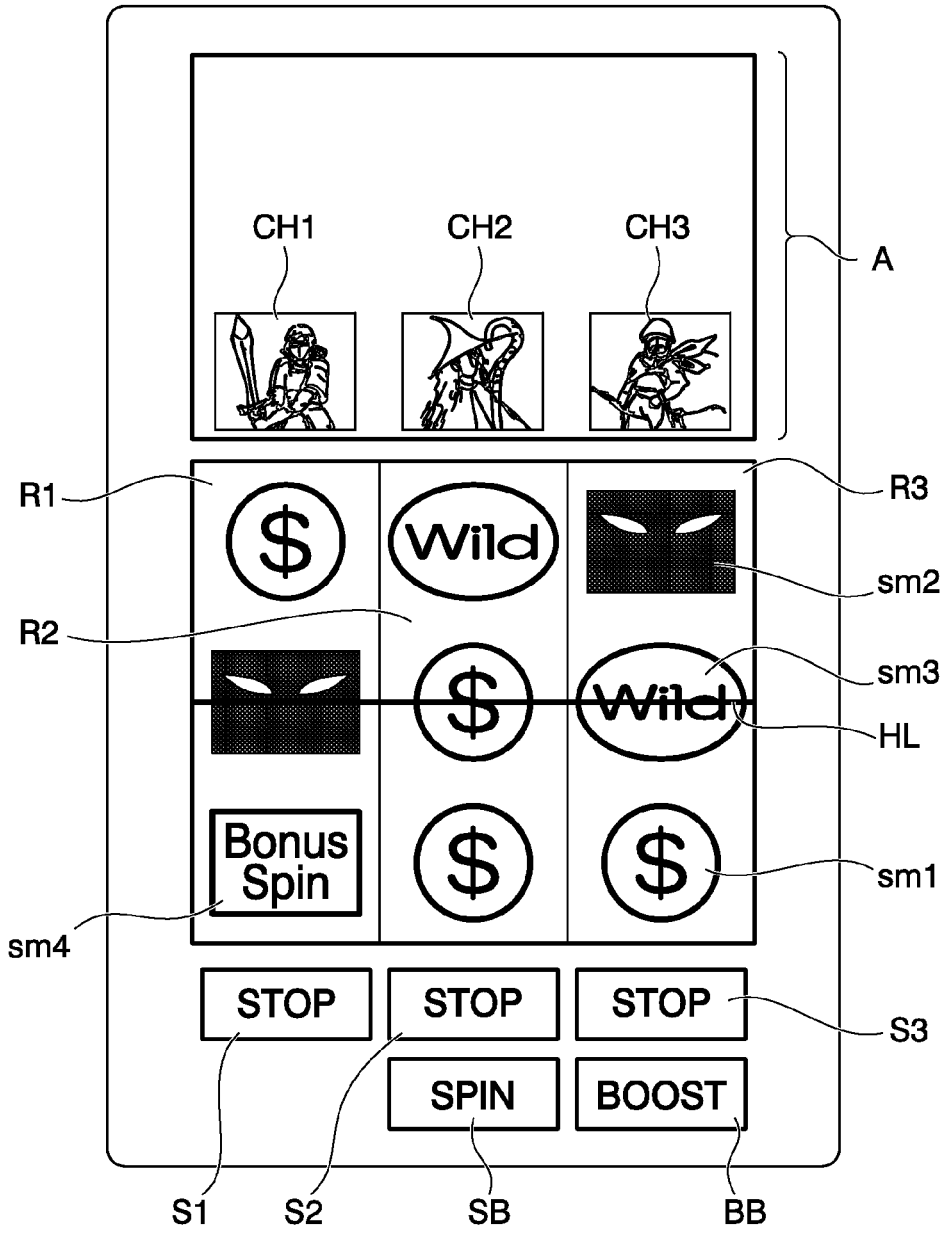
FIG. 15 is a view of an image displayed on the display screen of the terminal of FIG. 3 in a step, subsequent to the step of FIG. 14, involved in the transition until reaching the "slot game battle" in the game provided by the system of FIG. 3.

FIG. 15 shows an example of the screen showing the first mode. This display screen includes a region A including scenery and images of the characters CH1, CH2, and CH3, and reels R1, R2, and R3 corresponding to each of the characters. The character CH1 corresponds to the reel R1, the character CH2 corresponds to the reel R2, and the character CH3 corresponds to the reel R3. In the screen of FIG. 15, a spin button SB, a boost button BB, and stop switches S1, S2, and S3 are displayed. In the first mode, the stop switches S1, S2, and S3 and the boost button BB do not function, and when the spin button SB is operated, the slot reels R1, R2, and R3 spin and, after some time has elapsed, all the slot reels stop automatically.

Figure 16:
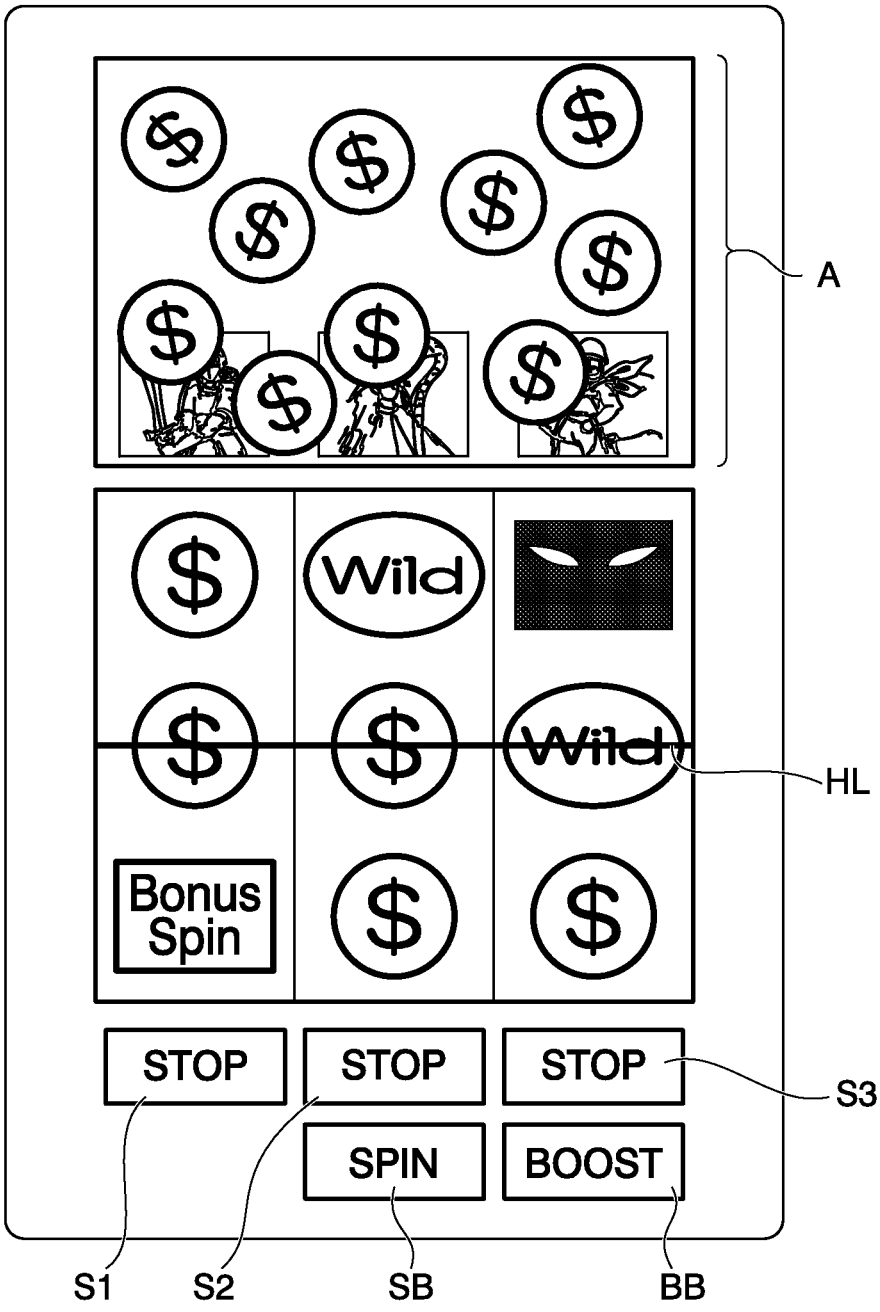
FIG. 16 is a view of an image displayed on the display screen of the terminal of FIG. 3 in a step, subsequent to the step of FIG. 15, involved in the transition until reaching the "slot game battle" in the game provided by the system of FIG. 3.

The slot game symbols in the first mode are, for example, a "coin" (sm1) that grants game currency to a player, a "monster" (sm2) that makes a monster appear, a wildcard (sm3) treated as an "almighty" symbol that can be used in place of any of the symbols, a "bonus spin" (sm4) that enables one spin without being counted in the number of spins, these symbols taking effect under the condition that they stop on the hit line HL (one example of the "prescribed position, for example, the center row). For example, if as shown in FIG. 16, a coin or a wildcard stops on the hit line HL of each reel, an effect image is displayed in the region A, and a prescribed number of coins are granted to the player character.

[Slot Game Battle]

Figure 17:
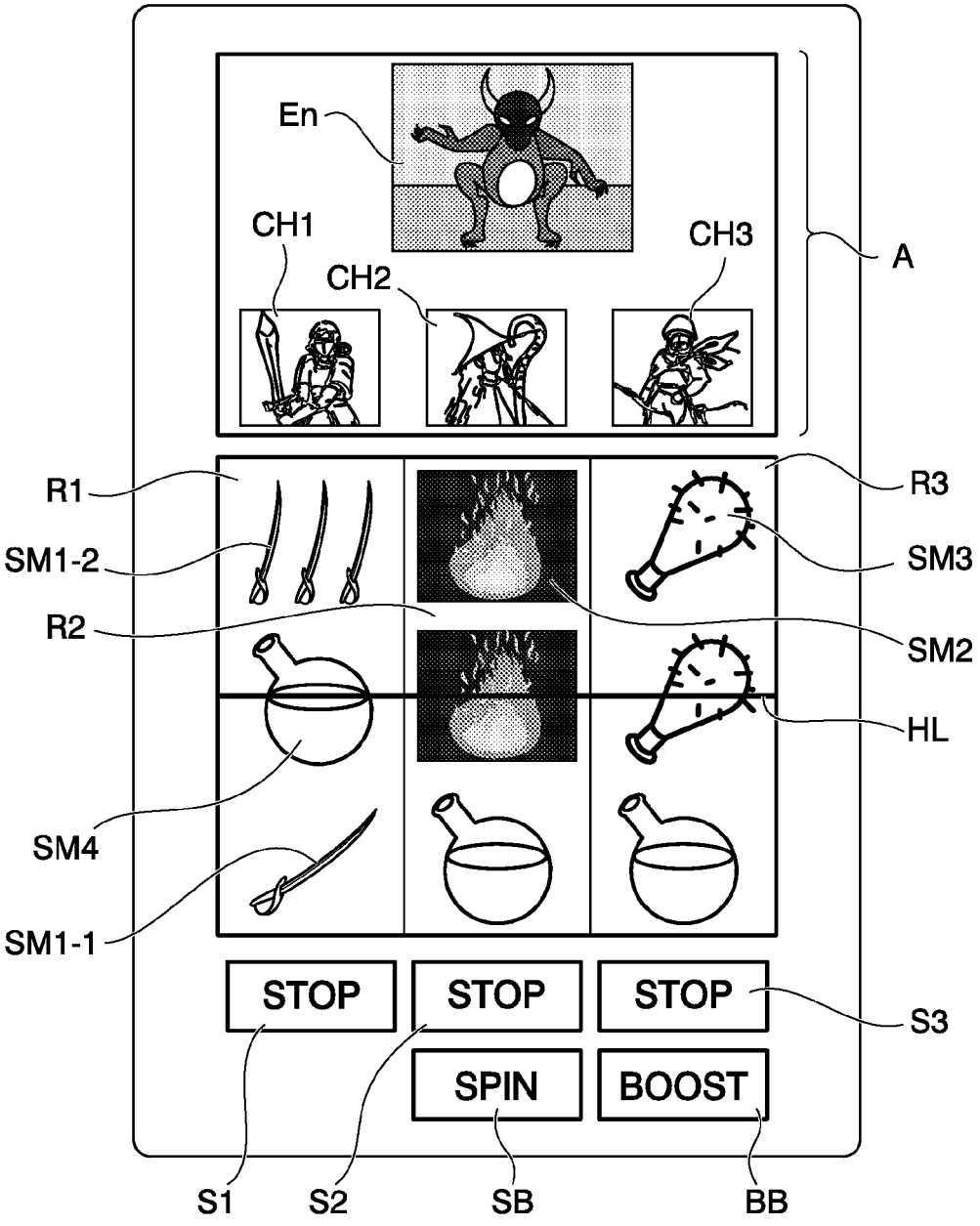
FIG. 17 is a view of an image displayed on the display screen of the terminal in a second mode of the game provided by the system of FIG. 3.

When, as shown in FIG. 15, at least one monster (sm2) stops on the hit line HL, the second mode starts. FIG. 17 is an example of the screen showing the second mode. In the second mode, an enemy character (character of the battle opponent) En is displayed in the region A, and the reel symbols are different from the symbols in the first mode. The symbols made available in the slot game in the second mode are, for example, different for each character. On the reel R1 corresponding to the character CH1 of the player, there exist symbols such as a "single saber" (SM1-1), a "group of sabers" (SM1-2), and "recovery medicine" (SM4). On the reel R2 corresponding to the character CH2 of another player, symbols such as "magic" (SM2) and "recovery medicine" (SM4) exist. On the reel R3 corresponding to the character of another player, symbols such as "bludgeon" (SM3) and "recovery medicine" (SM4) exist. A configuration may be adopted in which the same type of symbol is arranged in different reels, and in which the number (proportion) of symbols differs in each reel.

In the second mode, when the spin button SB is operated, all the slot reels spin, and, when each stop button is operated, the corresponding reel (positioned directly above the same) stops individually. Then, in accordance with the makeup of the symbols that have stopped on the hit line HL (an example of the prescribed position, for example, the center row) in each reel, a battle action such as an attack, a defense, or recovery from damage is executed. For example, if "recovery medicine" (SM4) stops on the hit line HL in the reel R1, the hit points of the first character CH1 recovers. Also, if "magic" (SM2) stops on the hit line HL in the reel R2, the enemy character En is subjected to a magical attack having an attack power in accordance with the parameter (magical attack power) of the second character CH2. If the "bludgeon" (SM3) stops on the hit line HL in the reel R3, the enemy character En is subjected to an attack with an attack power in accordance with the parameter (attack power) of the third character CH3.

In the same manner, a part or all of the first character CH1, the second CH2, and the third character CH3 are subjected to an attack from the enemy character En. Alternatively, the collective hit points of the first character CH1, the second character CH2, and the third character CH3 may be subjected to an attack.

In this manner, the battle progresses as damage is mutually done, and when the hit points of the enemy character En becomes zero, the first group (characters CH1 to CH3) wins. When the first group side wins, the game progression control unit 30 grants an item for game advantage and experience points and the like to the first character CH1, and the first character CH1 changes (improves). Accompanying this, the parameters of the second and third characters CH2 and CH3 may also be changed (improved).

In this case, the parameters of the first character CH1 and the parameters of the second and third characters CH2 and CH3 may influence the probability of a specific symbol stopping on the hit line HL in the associated reels R1 to R3. For example, in a reel associated with the character of a player having high parameters, the probability of a symbol executing a strong battle action may be increased. Also, the probability of a specific symbol stopping on the hit line HL in all reels may be determined in accordance with the sum or average, or the maximum value or the like of the parameters of all the characters CH1, CH2, and CH3.

[Optional Functions]

Figure 18:
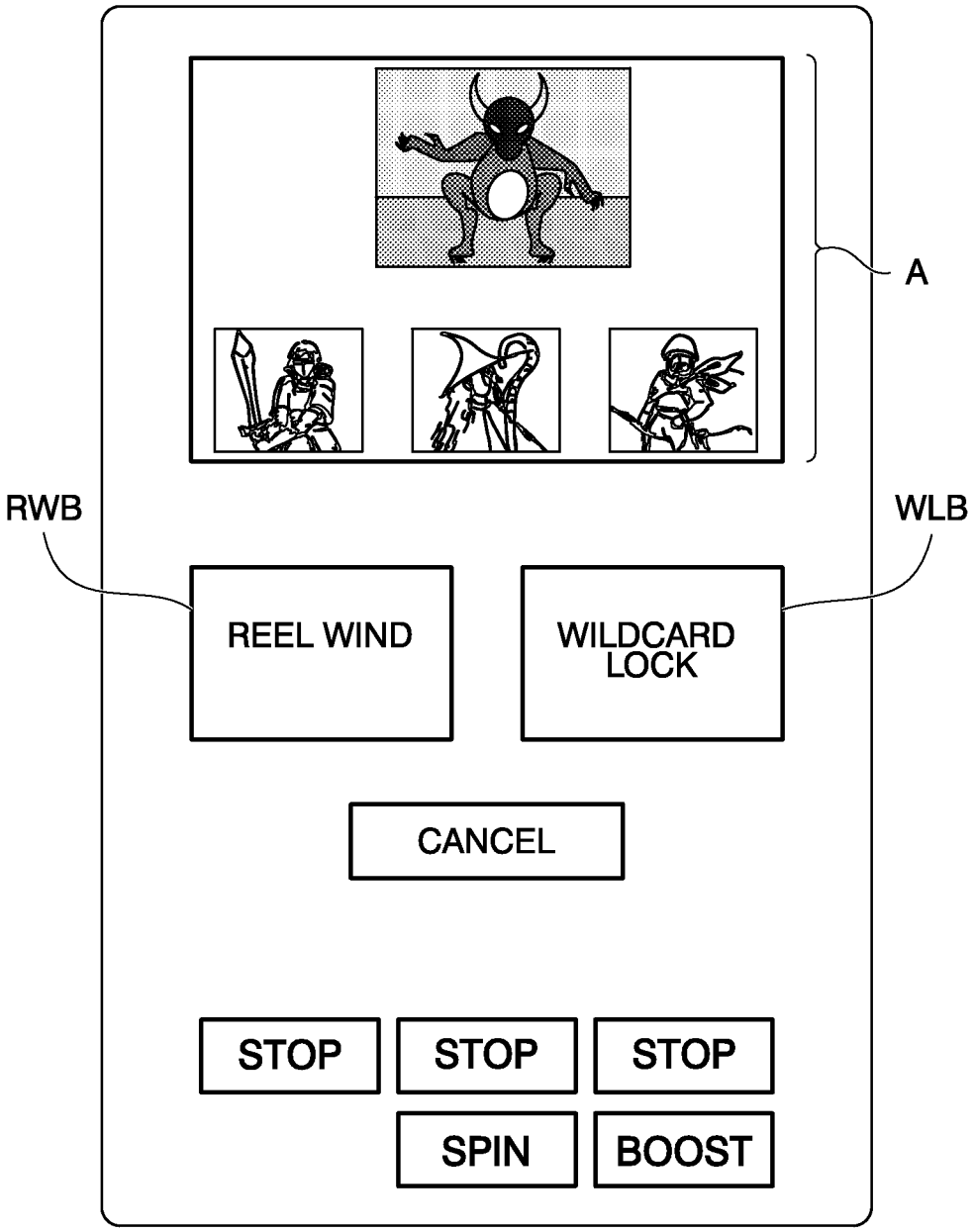
FIG. 18 is a view of an image displayed on the display screen of the terminal when a player operates a boost button BB in the game provided by the system of FIG. 3.
Figure 19:
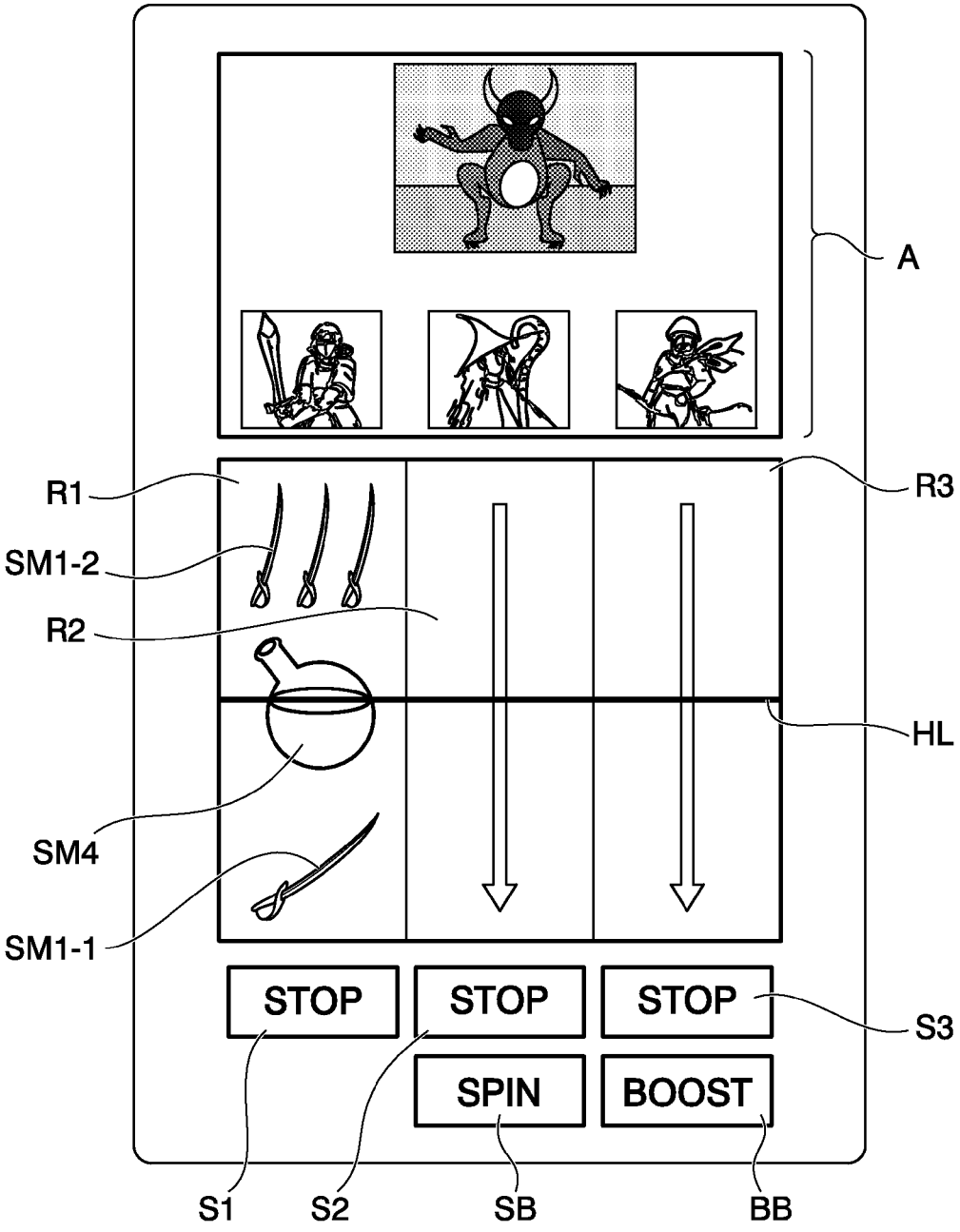
FIG. 19 is a view of an image, displayed on the display screen of the terminal, of a situation that reel wind has been executed, and "recovery medicine" (SM4) is stopped on the hit line HL of a reel R1, and the remaining reels R2 and R3 continue to spin in the game provided by the system of FIG. 3.

When the boost button BB is operated in the second mode, optional functions (reel wind and wildcard lock) that influence the behavior of the slot game are executed. When a player operates the boost button BB, the screen shown in FIG. 18 is displayed. When the player operates the button RWB that activates the reel wind in the screen shown in FIG. 18, the player can, during a prescribed number of spins, for example, move the left-side reel R1 to a desired position and hold it, while causing the remaining reels R2 and R3 to spin. FIG. 19 shows a situation that reel wind has been executed, "recovery medicine" (SM4) is stopped on the hit line HL of the reel R1, and the remaining slot reels R2 and R3 are spinning. As a result, the battle action of the first character CH1 is fixed as the desired battle action ("recovery" in the example of FIG. 19), and the player can have the first character CH1 execute the battle action (recovery) that he or she desires.

Figure 20:
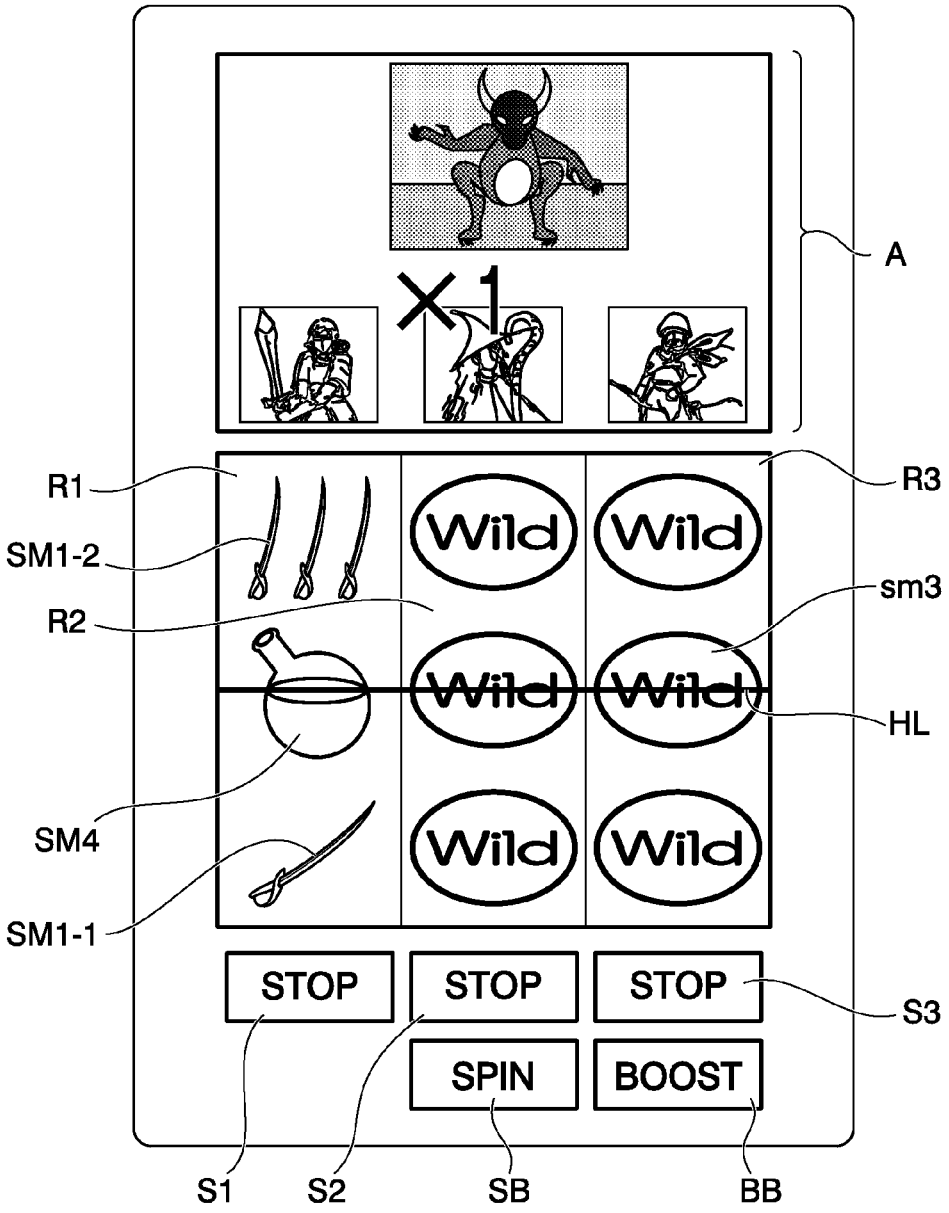
FIG. 20 is a view of an image, displayed on the display screen of the terminal, of a situation that a wildcard lock has been executed.

When the player operates the button WLB that activates the wildcard lock in the screen shown in FIG. 18, for example, the center and right-side reels R2 and R3 symbols all (or a majority thereof) are changed to wildcard (sm3). FIG. 20 shows the condition in which the wildcard lock has been executed. As a result, a battle action is executed that would be executed if a symbol that is the same as the symbol that stopped on the hit line HL in the left-side reel R1 ("recovery medicine" (SM4) in FIG. 20) stopped on all the slot reels R1, R2, and R3. As a result, a recovery action having a high degree of recovery (for example, hit points of all the characters greatly recovering) is executed. In addition, if the symbol that has stopped on the hit line HL in the left-side reel R1 is related to an attack, an attack action having a high force is executed.

In the second mode, each of the characters CH1, CH2, and CH3 might be granted items that increase their defensive strength, in accordance with the slot game results and the like, in which case the number of corresponding remaining times for the corresponding items are displayed on the character images in the form of ×1 or the like.

Figure 21:
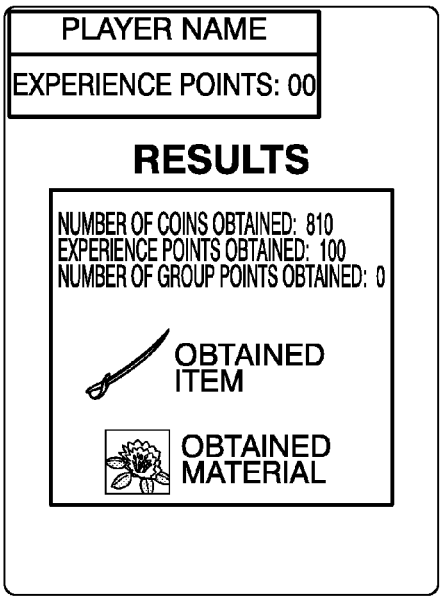
FIG. 21 is a view of an image, displayed on the display screen of the terminal, when a first character CH1 has satisfied the conditions for achieving a quest in the game provided by the system of FIG. 3.

FIG. 21 is an example of a screen displayed when the first character CH1 has satisfied the conditions for achieving a quest. The number of coins, the obtained experience points, and number of items and materials obtained by the first character CH1 are displayed in this screen. The things that have been acquired are housed, for example, in a virtual warehouse, and can be viewed by the player when the quest has been achieved. A quest is not necessarily successful, and when the hit points of the first character CH1 becomes zero in the second mode, or when the spins during the quest has reached an upper limit value, the quest is treated as having failed.

[Processing Flow]

Figure 22:
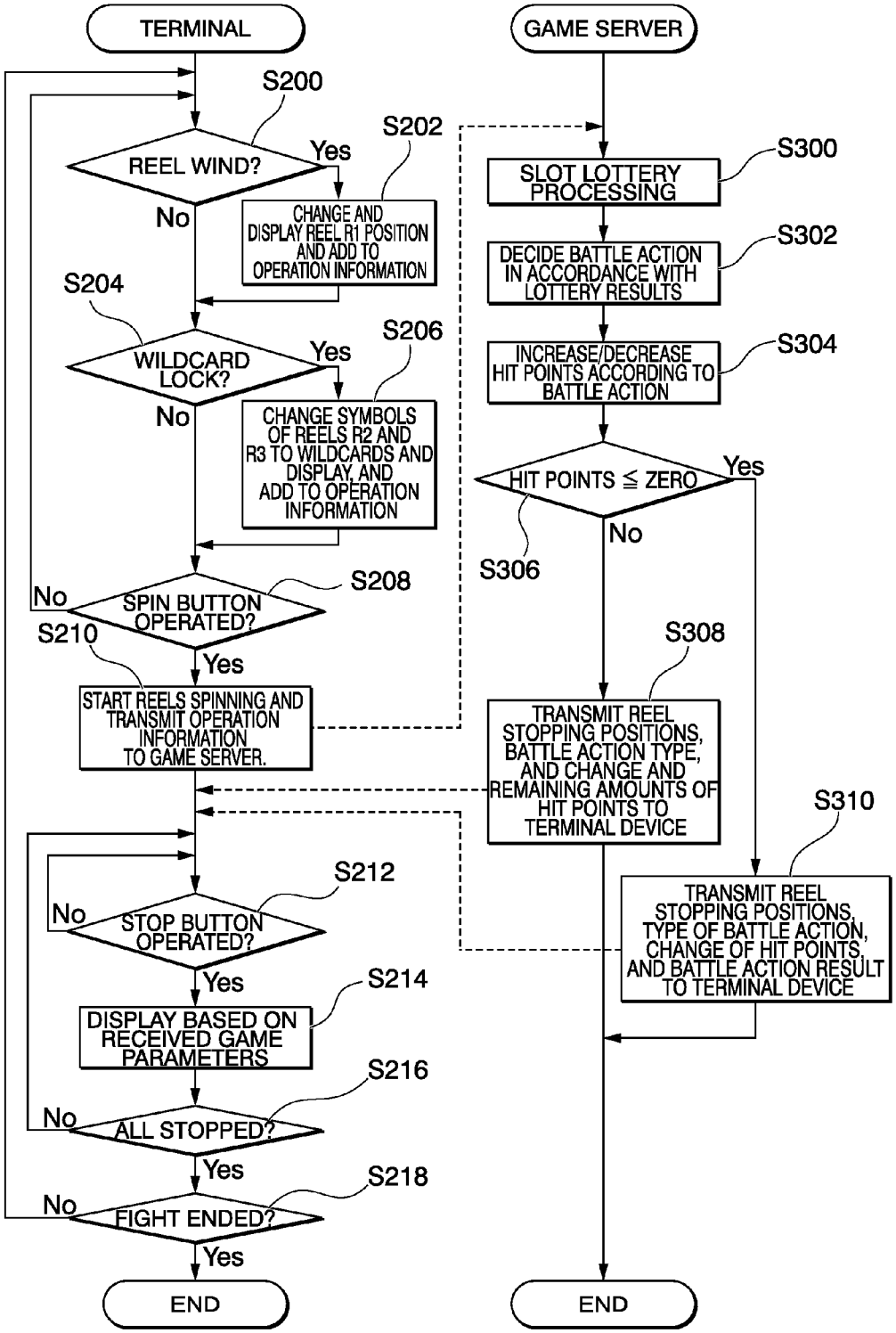
FIG. 22 is a flow chart of a process executed by the terminal and the game server in the system of FIG. 3.

FIG. 22 is an example of a flowchart of processing executed by the terminal 100 and the game server 1 of the present embodiment.

First, the operation information generation unit 140 of the terminal 100 judges whether or not the player has selected reel wind (step S200). If the player has selected reel wind, the terminal display control unit 150 of the terminal 100 changes the position of the reel R1 to the position of the player operation and displays this on the touch panel 110, the operation information generation unit 140 adding the verified position to the operation information (step S202).

Next, the operation information generation unit 140 of the terminal 100 judges whether or not the player has selected wildcard lock (step S204). If the player has selected wildcard lock, the terminal display control unit 150 of the terminal 100 changes the symbols of the slot reels R2 and R3 to wildcards and displays these on the touch panel 110, and the operation information generation unit 140 adds information indicating that wildcard lock has been selected to the operation information (step S206).

Next, the operation information generation unit 140 of the terminal 100 judges whether or not the player has operated the spin button SB (step S208). If the player has operated the spin button SB, the terminal display control unit 150 displays on the touch panel 110 an image of the slot reels R1 to R3 starting to spin, and the operation information generation unit 140 transmits the operation information to the game server 1 (step S210).

Upon receiving the operation information, the slot game lottery unit 50 of the game server 1 performs slot game lottery processing (step S300). That is, it decides the stopping positions of the slot reels R1 to R3 by random number processing or the like.

The battle action decision unit 50 of the game server 1, references the lottery results (stopping positions of each reel) of the slot game lottery unit 50, and decides the battle actions corresponding to the symbols stopped on the hit line HL as the battle actions of the first group characters CH1 to CH3 (step S302).

When the battle actions are decided, the win/lose determination unit 70, in accordance with the battle actions of characters on both sides, increases or decreases the hit points of the characters on both sides (step S304). Specifically, the win/lose determination unit 70, in accordance with the battle actions of the first group characters, decreases the hit points of the enemy character or increases the defensive strength first group characters, or causes recovery of the hit points of the first group characters. The win/lose determination unit 70 also performs processing whereby, in accordance with the enemy character parameters, the hit points of the first group characters is decreased, in accordance with the battle action. The increasing and decreasing of hit points is still internal processing, and does not appear on the display screen of the terminal 100.

The win/lose determination unit 70 then, as a result of the processing at step S304, determines whether or not the hit points of one of the characters has become zero or lower (step S306). If hit points of neither of the characters has become zero or lower, the game progression control unit 30 of the game server 1 transmits the stopping positions and battle actions of each reel that had been spun, and the variations and remaining amount of hit points of characters on both sides (or, alternatively, on one side) to the terminal 100 as game parameters (step S308). However, if the hit points of one of the characters has become zero or lower, the game progression control unit 30 transmits the stopping positions and battle actions of the slot reels that have been spun, the variations in hit points of the characters on both sides, and the battle results (the side the hit points of which has become zero or lower being the loser) to the terminal 100 as game parameters (step S310).

Upon receiving the game parameters, the terminal 100 waits until the player operates one of the stop buttons (S1 to S3) (step S212). When a player operates one of the stop buttons, the terminal display control unit 150 of the terminal 100 controls the touch panel 110 so as to make a display based on the game parameters received from the game server 1 with regard to the reel and character corresponding to the operated stop button (step S214). Specifically, the terminal 100 displays an image in which the reel corresponding to the stop button has stopped at a position indicated by the game parameters and displays an image corresponding to the battle action in accordance with the symbol of the reel that has stopped on the hit line HL, causing variation in parameters such as hit points to be reflected in the screen, and, if battle results have been received from the game server 1, displays the win or loss and the like. Next, the terminal 100 judges whether or not all the stop buttons have been operated and all the slot reels have stopped (step S216). If all the slot reels have not stopped, return is made to step S212. If all of the slot reels have stopped, the terminal 100 judges whether or not the battle has ended (step S218) and, if the battle has not ended, return is made to step S200, but if the battle has ended, the processing of the flowchart of FIG. 22 is ended.

[Other Screens]

Figure 23:
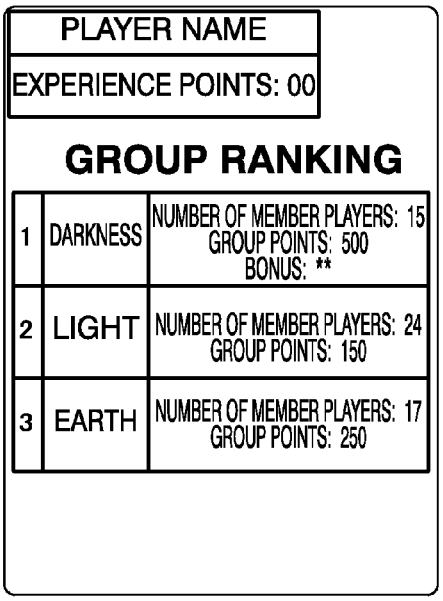
FIG. 23 is a view of an image, displayed on the display screen of the terminal, when verifying group ranking in the game provided by the system of FIG. 3.

FIG. 23 is an example of a screen for verification of the group status. The parameters shown of the screen shown in FIG. 23 are generated and transmitted to the terminal 100 by the second group management unit 80. In the screen shown in FIG. 23, in addition to the number of points calculated from the level of achievement of the quest for each group being displayed, a ranking is made according to the number of points. A bonus such as an item or the like may be granted to a player who has obtained a high number of points.

Figure 24:
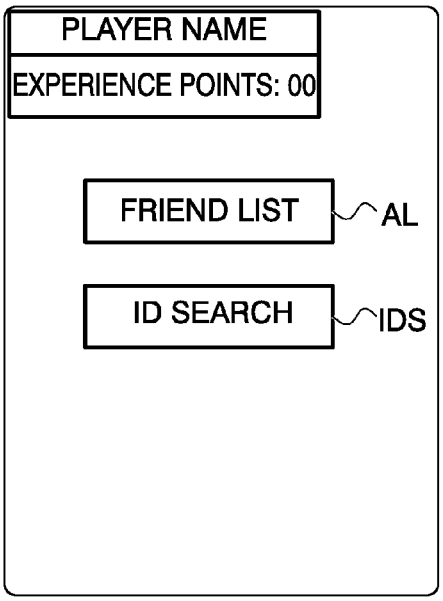
FIG. 24 is a view of an image, displayed on the display screen of the terminal, for adding and setting characters that can be joined into a first group as the second and third characters in the game provided by the system of FIG. 3.
Figure 25:
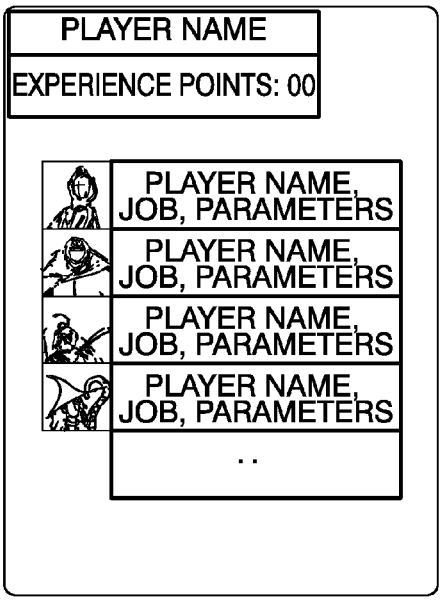
FIG. 25 is a view of an image, displayed on the display screen of the terminal, of a friend list appeared when a friend list button (AL) is operated in the game provided by the system of FIG. 3.
Figure 26:
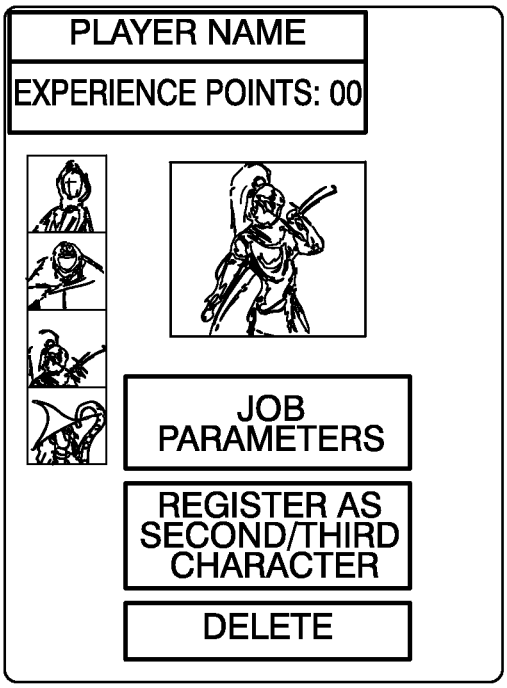
FIG. 26 is a view of an image, displayed on the display screen of the terminal, for changing the setting of the game when a particular character is selected in the game provided by the system of FIG. 3.
Figure 27:
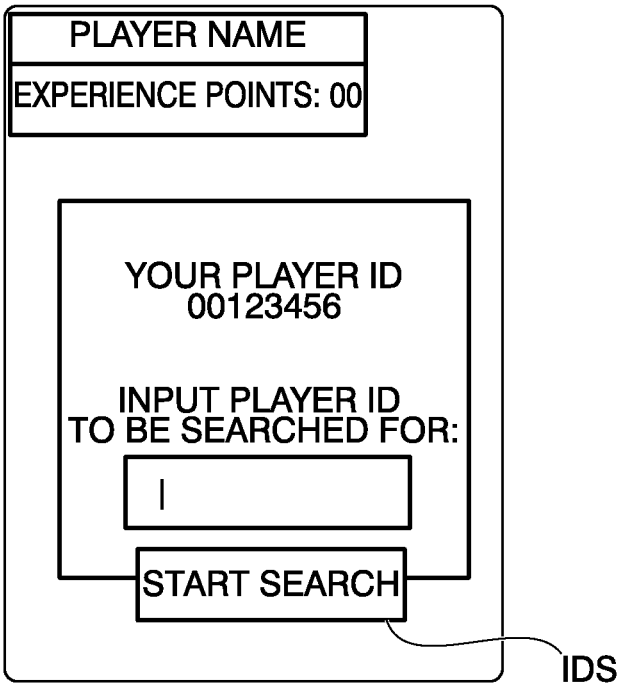
FIG. 27 is a view of an image, displayed on the display screen of the terminal, for a search for a friend using a player ID when an ID search button IDS is operated.

FIG. 24 is a screen for adding and setting characters that can be joined into the first group as the second and third characters. A player that can join the first group as the second or third character, for example, is the character of a player in the same second group (member of "Light" or of "Darkness", or of "Earth") as the first character. In the screen shown in FIG. 24, when the friend list button (AL) is operated, the friend list shown in FIG. 25 is displayed. When a particular character is selected in the screen shown in FIG. 25, the setting change screen shown in FIG. 26 is displayed. From the screen shown in FIG. 26, settings such as whether or not to register as the second or third character can be made. If the ID search button IDS is operated from the screen shown in FIG. 24, the screen shown in FIG. 27 is displayed, and a search can be done for a friend, using a player ID, which is information that identifies a player.

[Sub-Symbols]

Figure 28:
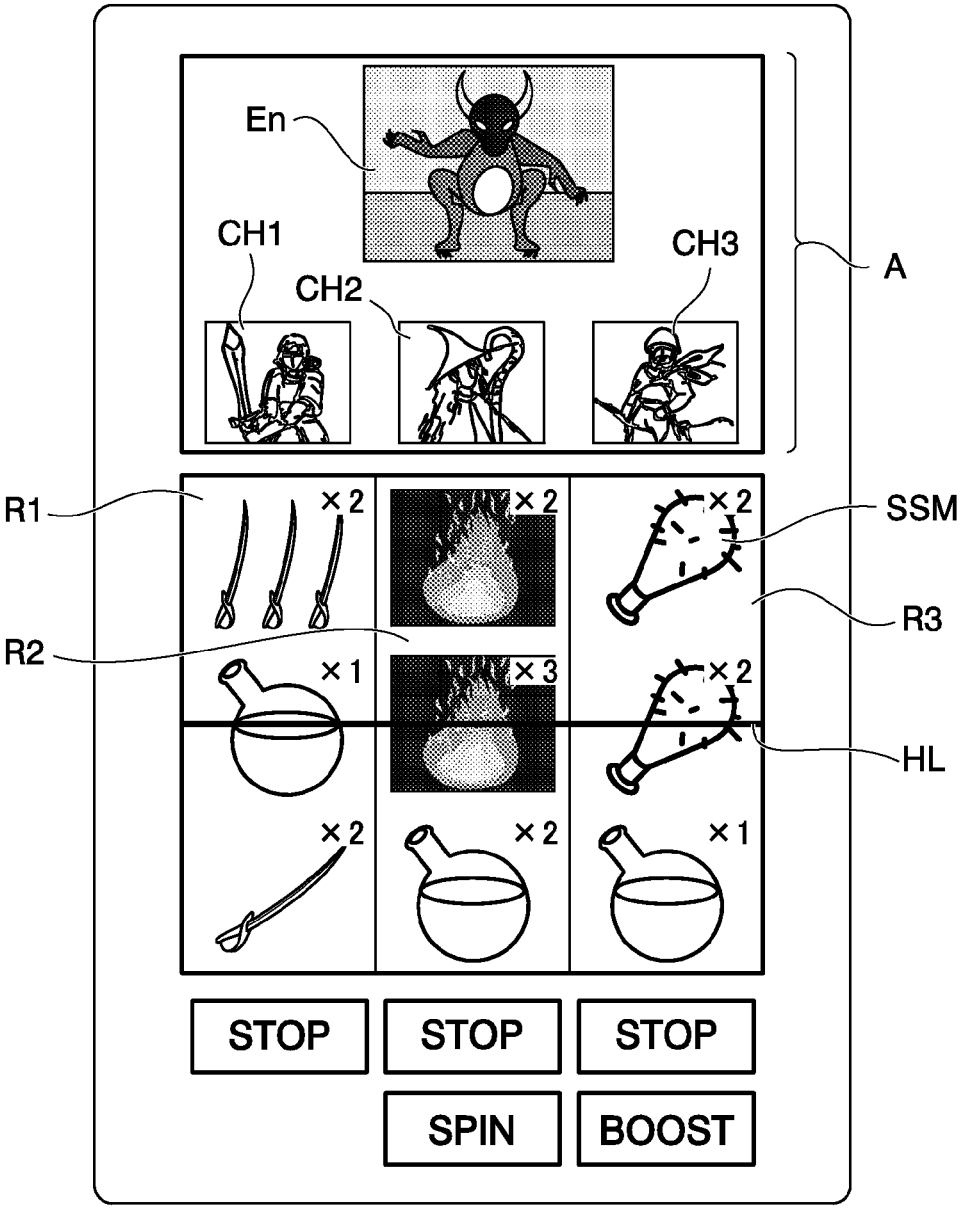
FIG. 28 is a view of an image, displayed on the display screen of the terminal, that sub-symbols SSM including numerical information are added to each of symbols of the slot game in the second mode of the game provided by the system of FIG. 3.

In the first mode or the second mode, sub-symbols may be added to each of the symbols in the slot game. FIG. 28 shows the situation in which sub-symbols SSM including numerical information are added to each of the symbols (called main symbols) of the slot game in the second mode. As shown in FIG. 28, the sub-symbols include, for example, numerical information (×2, ×3, and the like), and take into consideration individual values, the total value, the maximum value, and a multiplier value of numerical information of the sub-symbols that have stopped on the hit line HL in the slot reels R1 to R3 with respect to the symbol effects (payout, attack points, defense points, amount of recovery, and the like). The expression "take into consideration" refers to the performing of additions, subtractions, and multiplications and the like. For example, as shown in FIG. 28, if the main symbol "magic" to which the sub-symbol ×3 is added in the center reel R3 stops on the hit line HL, then a magical attack having a three-fold magical attack points (the magical attack power plus the effect of gear and the like) is executed. If the main symbol "recovery" stops on the hit line HL in all reels, if the sub-symbols on the hit line HL are ×2, ×3, and ×1, a recovery from damage action is executed with six-fold recovery points by the multiplication of these points.

Figure 29:
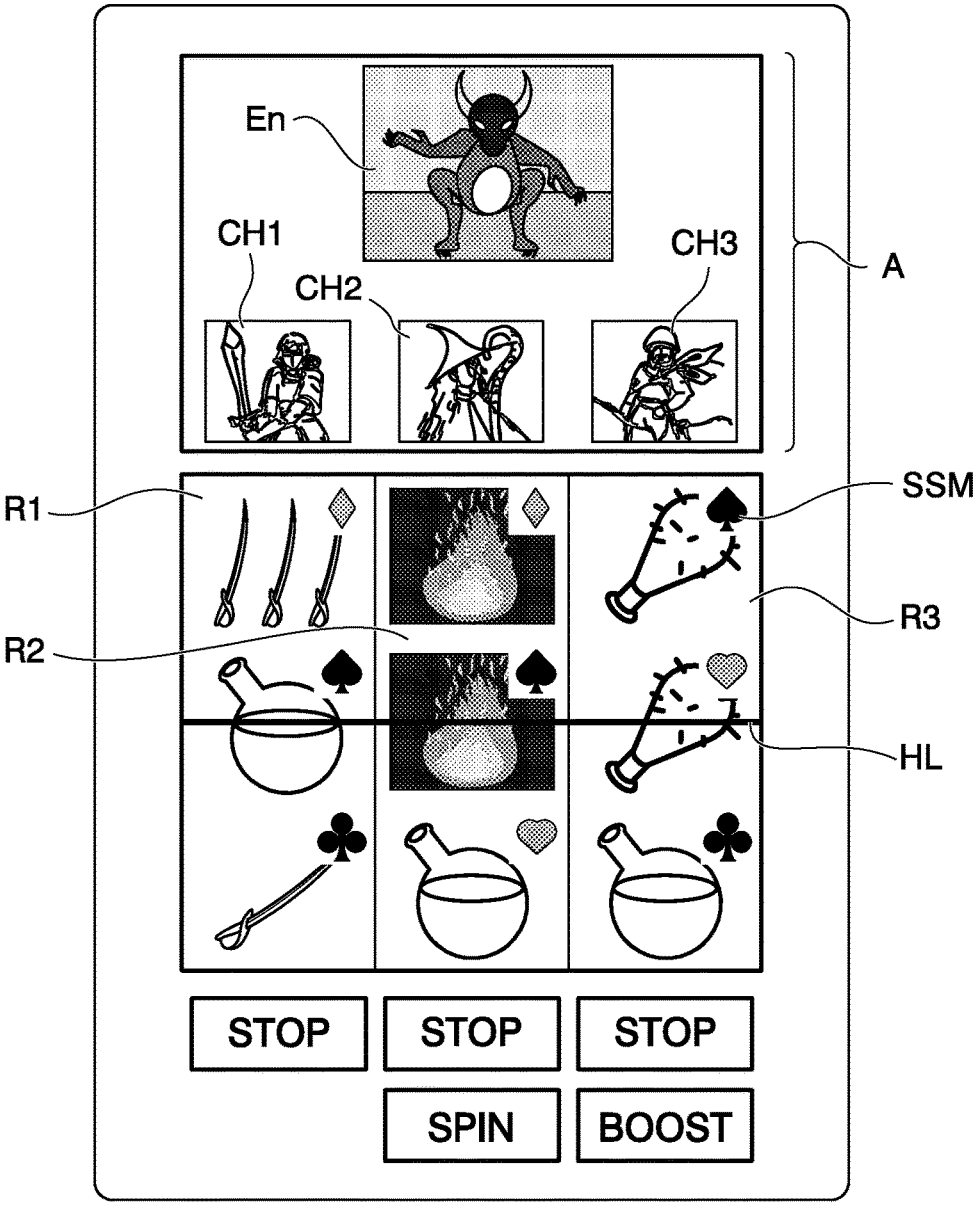
FIG. 29 is a view of an image, displayed on the display screen of the terminal of the second mode where the sub-symbols SSM are added as graphics to the main symbols in the game provided by the system of FIG. 3.

FIG. 29 shows a situation in which, in the second mode, the sub-symbols SSM are added as graphics to the main symbols. As shown in FIG. 29, the sub-symbols are marks (such as playing card suits), to each of which is assigned an effect, the effects of the sub-symbol marks that have stopped on the hit line HL in each of the slot reels R1 to R3 being reflected in the payout and battle action and the like of the slot game. If the same mark (for example, the spade) appears along the entire hit line HL, a larger added effect is reflected in the slot game payout, battle action, and the like.

SUMMARY

According to an embodiment of the game device, the game control method, and the storage medium (hereinafter "game device and the like") described above, because battle action in accordance with not only the parameters of the first character of the player, but also in accordance with the parameters of the other players' second and third characters is done, it is possible to have the player feel as though he or she is cooperating with other players in playing the game. By this arrangement, the game device and the like of the present embodiment causes communication regarding the game, and can broaden the enjoyment of the game.

According to the game device and the like of the present embodiment, because each reel is associated with the first character of the player or the other players' second and third characters, and battle action is done in accordance with the stopping positions of each reel and the parameters of the character associated therewith, it is possible to have the player feel that he or she is operating not only the player own character, but also the second and third characters of other players, thereby enabling a deeper game to be provided.

According to the game device and the like of the present embodiment, because the parameters of the second and third characters are parameters that reflect the result of the other players playing the game with his or her first character, it is possible to impart the motivation to strengthen his or her own first character, thereby evoking the desire to play the game.

According to the game and the like of the present embodiment, the first character of the player belongs to one of a plurality of groups, characters selectable as the second and third characters being characters belonging to the same group as the first character of the player, and because the result of battle between groups for the total number of points obtained by characters within a group are presented, the player can be provided with a multiple level of enjoyment, and it is possible to evoke in the player a desire to play the game.

According to the game and the like of the present embodiment, because an optional function that, after stopping a part of the slot reels at positions desired by the player, spins the slot reels other than those that are stopped, and an optional function that, after changing a part of the slot reels to wildcards, spins all of the slot reels, are provided to the player, the possibility of symbols having a high effect stopping at the prescribed positions is increased, enabling speedy progression of the game.

According to the game device and the like of the present embodiment, with main symbols and sub-symbols existing on the slot reels of the slot game, because, as a result of the slot reels spinning, an added effect is generated with respect to the battle actions and the like in accordance with the sub-symbols that have stopped at prescribed positions on each reel, the player can be provided with a multiple level of enjoyment, it is possible to evoke in the player a desire to play the game.

[Modifications]

Although the foregoing has been described the illustrative embodiments of the present invention, the embodiments of the present invention should not be limited to the above-described ones, and may be subjected to various changes, modifications or replacements.

For example, although in the above-noted embodiment each time of spinning in the slot game the terminal 100 and the game server 1 communicate, and the lottery results (stopping position of the slot reels) by the slot game lottery unit 50 are transmitted by the game server 1 to the terminal 100, those configurations may be modified. For example, the terminal 100 and the game server 1 may be configured to communicate in units of groups in the first mode and the second mode. The term "in units of groups" means, for example, the terminal 100 and the game server 1 communicating at some pre-established timing, such as at the start or end of a quest, or the start or end of battle using the slot game.

In the above case, at the above-noted occurrence of communication, the game server 1 transmits to the terminal 100 the stopping positions for a plurality of times, or a random number used as the basis for the calculation thereof. For example, at the start of a battle by a slot game, the reel stopping positions for the upper limit of the number of spins (or up until the end of the battle) are decided by the slot game lottery unit 50 and transmitted to the terminal 100, and each time the terminal operates the spin switch, the terminal 100 successively accesses the reel stopping positions of the received number of times and stops the slot reels. Alternatively, for example, at the start of a battle by a slot game, the slot game lottery unit 50, the battle action decision unit 60, and the win/lose determination unit 70 may be configured to decide game parameters that include the reel stopping positions for a plurality of times, and the win/lose outcome based thereon, and the game server 1 may be configured to transmit these to the terminal 100, the terminal 100 may be configured to decide the displayed content by successively referencing the received information each time the player operates the spin switch.

Figure 30:
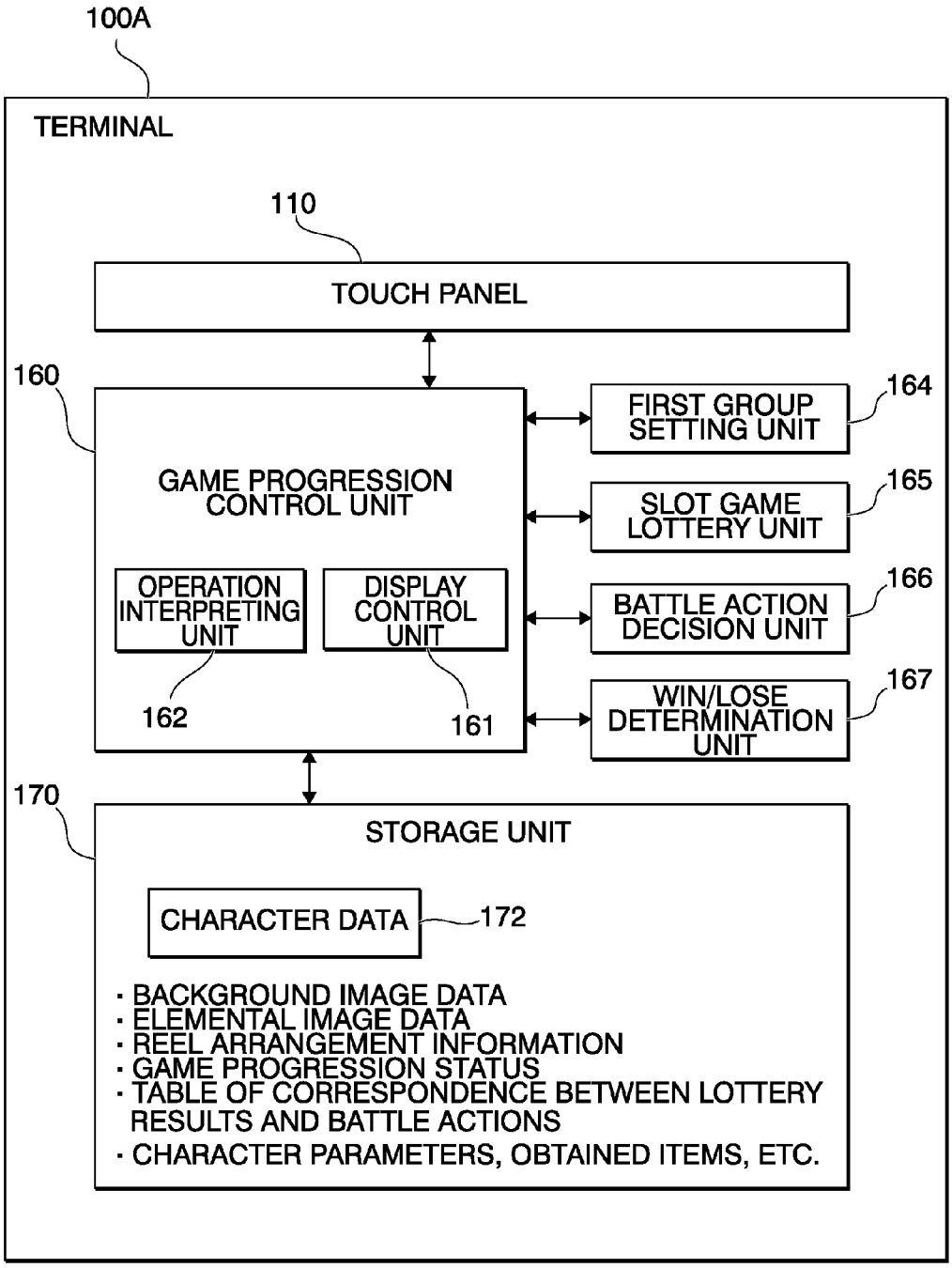
FIG. 30 is a view of configurations of a terminal designed to perform as a stand-alone game device in other embodiments of the present invention.

Also, the second and third characters that belong to the first group, rather than being the current player character, may include virtual characters provided to participate in a group, or may be only virtual characters. In the latter case, the processing regarding the game progression may be performed by the terminal, the terminal functioning as a stand-alone game device, where supplementary information may be communicated with the game server. FIG. 30 shows an exemplary configuration of a terminal 100A functioning as a stand-alone game device. In FIG. 30, the terminal 100A has, for example, a touch panel 110, a game progression control unit 160, a first group setting unit 164, a slot game lottery unit 165, a battle action decision unit 166, a win/lose determination unit 167, and a storage unit 170. The game progression control unit 160 has an operation interpreting unit 161 and a display control unit 162.

The operation interpreting unit 161 may be configured to interpret operations made by the player on the display screen that is displayed on the touch panel 110 by the display control unit 162. The game progression control unit 160 may be configured to perform overall control of the game provided in the terminal 100A, based on the player operations interpreted by the operation interpreting unit 161, and to generate internal parameters having the same content as the game parameters in the above-noted embodiment. The display control unit 162 may be configured to generate and display a display screen on the touch panel 110, based on the internal parameters generated by the game progression control unit 160. Because the screens displayed by the terminal 100A on the touch panel 110 are the same as in the above-noted embodiment, they will not be illustrated again.

The first group setting unit 164 may be configured to set a party (first group) that includes the first character of the player and the second and third characters that accompany the first character on an adventure. The slot game lottery unit 165 may be configured to perform lottery regarding the slot game executed within the game, and to decide the reel stopping positions. The slot game lottery unit 165 may be configured to decide the reel stopping positions by random number processing or the like, and may be configured to decide the reel stopping positions so that the slot reels stop when a certain amount of time has elapsed from the point in time when the spin button is operated. The battle action decision unit 166 may be configured to decide the battle action of the player character, in accordance with the processing results of the slot game lottery unit 165. The win/lose determination unit 167 may be configured to calculate the damage (reduction in hit points) of each character in accordance with the battle action of the player character, and to decide the winner based on the remaining amount of hit points. The processing of these functional units are the same as the processing of the first group setting unit 40, the slot game lottery unit 50, the battle action decision unit 60, and the win/lose determination unit 70 in the above-described illustrative embodiments.

The storage unit 170 may be configured to store, in addition to character data 172, data such as background image data and elemental image data, for example, image data for characters, symbols on the slot game reels, display parameters, and items and the like), for various modes, data indicating the game progression (part of the internal parameters), reel symbol arrangement information, a table of correspondence between slot game lottery results and battle actions, character parameters, and data of obtained items. The character data 172 is, for example, the same as that shown in FIG. 4, and characters other than the first character of the player are actually existing player characters, but rather virtual characters that are provided beforehand.

Figure 31:
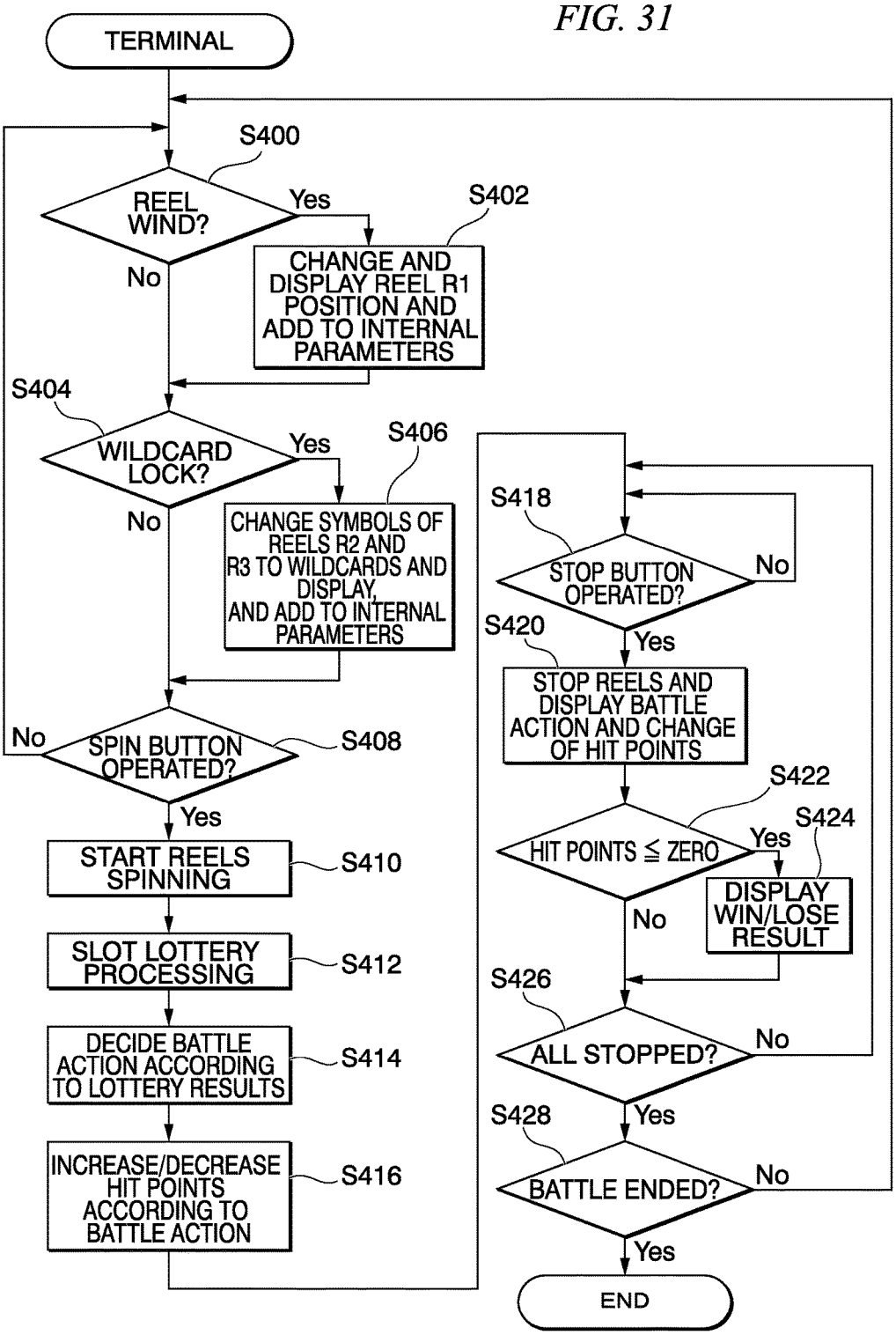
FIG. 31 is a flow chart of a process executed by the game device of FIG. 30.

FIG. 31 is an example of a flowchart showing the flow of processing executed by the terminal 100A, which functions as a stand-alone game. First, the operation interpreting unit 161 judges whether or not the player has selected a reel wind (step S400). If the player has selected a reel wind, the display control unit 162 changes the reel R1 position to the position of the player operation, and the operation interpreting unit 161 adds the established position to the internal parameters (step S402).

Next, the operation interpreting unit 161 judges whether or not the player has selected wildcard lock (step S404). If the player has specified wildcard lock, the display control unit 162 changes the symbols of the slot reels R2 and R3 to wildcards, displays them on the touch panel 110, and adds information indicating that wildcard lock has been selected to the internal parameters (step S406).

Next, the operation interpreting unit 161 of the terminal 100A judges whether or not the player has operated the spin button SB (step S408). When the player operates the spin button SB, the display control unit 162 displays on the touch panel 110 an image of the slot reels R1 to R3 that have started to spin (step S410).

Next, the slot game lottery unit 165 performs slot game lottery processing (step S412). That is, it decides the stopping positions of the slot reels R1 to R3, by random number processing or the like. The battle action decision unit 166 references the lottery results (stopping positions of each reel) of the slot game lottery unit 165 and decides battle actions in accordance with the symbols stopped on the hit line HL as the battle actions of the characters CH1 to CH3 of the first group (step S414). When the battle actions are decided, the win/lose determination unit 167, in accordance with the battle actions of both characters, increases or decreases the hit points of the characters (step S416). Specifically, the win/lose determination unit 167, in accordance with a battle action of the characters of the first group, decreases the hit points of the enemy character and increases the defensive strength of the characters of the first group, and causes the characters of the first group to recover their hit points. The win/lose determination unit 167, in accordance with the battle action of the enemy character, performs processing such as processing to reduce the hit points of the first group characters. This increase and decrease of hit points are still internal processing, and do not appear on the display screen of the terminal 100. The processing of steps S412 to S416 may be done after the player operates the stop buttons (S1 to S3).

Next, the operation interpreting unit 161 waits until the player operates one of the stop buttons (step S418). When one of the stop buttons is operated, the display control unit 162 stops the reel corresponding to the operated stop button at the stopping position decided by the slot game lottery unit 165, displays an image corresponding to the battle action, and reflects the change in the parameter of hit points and the like in the screen (step S420). Next, the win/lose determination unit 167 determines whether or not the hit points of one of the characters is zero or below (step S422). If the hit points of one of the characters is judged to be zero or below, the terminal display control unit 150 displays the win/lose outcome (step S424).

Next, the game progression control unit 160 judges whether all of the stop buttons have been operated and all of the slot reels have stopped (step S426). If all of the slot reels have not stopped, return is made to step S418. If all of the slot reels have stopped, the game progression control unit 160 judges whether or not the battle has ended (step S428) and, if the battle has not ended, return is made to step S400, but if the battle has ended, the processing of the flowchart of FIG. 31 is ended.

In the above-noted configurations and processing, the terminal 100A, which functions as a stand-alone game device, provides to the player a game that is the same as described in the above-noted embodiment. According to the terminal 100A, it is possible to broaden the enjoyment of the game and impart depth to the game.

[Hardware Configurations]

The game server 1 and the terminals 100 and 100A in the above-described embodiments have therewithin a computer system. A "computer system" encompasses hardware such as a CPU (central processing unit), a memory device such as RAM or the like, a storage device such as a ROM, a hard-disk drive, or a flash memory, a drive apparatus for a removable storage medium, and peripheral devices and the like.

The operating processes of the game progression control unit 30, the first group setting unit 40, the slot game lottery unit 50, the battle action decision unit 60, the win/lose determination unit 70, and the second group setting unit 80 of the game server 1, and the operation information generation unit 140, the terminal display control unit 150 of the terminal 100, as well as the game progression control unit 160, the operation interpreting unit 161, the display control unit 162, the first group setting unit 164, the slot game lottery unit 165, the battle action decision unit 166, and the win/lose determination unit 167 of the terminal 100A that functions as a stand-alone game device are, for example, stored in a computer-readable recording medium in the form of a program, and the above-noted processing can be performed by a computer system reading and executing this program. Also, rather than all of the processing of each functional part being performed by execution of the program, a part of the functional parts may be implemented by hardware such as an IC (integrated circuit), and an LSI (large-scale integration) device.

In some aspects of the invention, a game device may include, but is not limited to, a first setting unit, a lottery unit, a decision unit, and a determination unit. The first setting unit may be configured to set a first character for a first player and a second character different from the first character, both the first and second characters belonging to a first group. The lottery unit may be configured to decide stop positions of spinning slot reels displayed on a display. The decision unit may be configured to decide a battle action of the first group, with reference to the stop positions of the spinning slot reels of the first reel group decided by the lottery unit, and on the basis of symbols to be stopped at the stop positions and on the basis of parameters of the first and second characters. The determination unit may be configured to decrease hit points of an enemy character in response to the battle action of the first group decided by the decision unit. The determination unit may be configured to decrease hit points of at least one of the first and second characters belonging to the first group in response to another battle action by the enemy character. The determination unit may also be configured to determine a winner based on respective remaining amount of the hit points of the at least one of the first and second characters and the enemy character.

In some cases, the game device may be configured by plural computing devices such as terminals and a server computer, which are operatively coupled to each other via any available connection such as any available network. In some cases, the game device may be configured by a single computing device such as a terminal. The terminal may be any game device which is configured to be dedicated to a game machine or a communication terminal which is configured to communicate through any network to a server computer and which is not dedicated as a gaming device. In those configurations mentioned above, each computer, a terminal or a server computer may be implemented by a storage storing a computer readable program and a processor to execute the program to perform the functions and/or operations of the lottery unit, the decision unit, and the determination unit.

Typical examples of the first setting unit configured to set a first character for a first player and a second character different from the first character may be, but are not limited to, a first group setting unit 40 configured to set the player character and the party (first group) that accompanies the player character on an adventure as described in the illustrative embodiments. Typical examples of the first setting unit may be, but are not limited to, a first group setting unit 164 configured to set a party (first group) that includes the first character of the player and the second and third characters that accompany the first character on an adventure as described in the illustrative embodiments.

Typical examples of the lottery unit configured to decide stop positions of spinning slot reels displayed on a display may be, but are not limited to, a slot game lottery unit 50 configured to perform lottery regarding the slot game executed within the game, and to decide the stopping positions of the slot reels as described in the illustrative embodiments. Typical examples of the lottery unit may be, but are not limited to, a slot game lottery unit 165 configured to perform lottery regarding the slot game executed within the game, and to decide the reel stopping positions by random number processing or the like, and to decide the reel stopping positions so that the slot reels stop when a certain amount of time has elapsed from the point in time when the spin button is operated as described in the illustrative embodiments.

Typical examples of the decision unit configured to decide a battle action of the first group may be, but are not limited to, a battle action decision unit 60 configured to decide the battle action of as an enemy character, based on the parameters of the characters belonging to the first group as described in the illustrative embodiments. Typical examples of the decision unit configured to decide a battle action of the first group may be, but are not limited to, a battle action decision unit 166 configured to decide the battle action of the player character, in accordance with the processing results of the slot game lottery unit 165 as described in the illustrative embodiments.

Typical examples of the determination unit configured to decrease hit points of an enemy character and at least one of the first and second characters and to determine a winner based on respective remaining amount of the hit points may be, but are not limited to, a win/lose determination unit 70 configured to calculate the variable amount of hit points of each character, in accordance with the parameters of the characters belonging to the first group, the battle actions of the characters belonging to the first group, and the battle action of the enemy character, and to determine a winner based on the remaining amount of those hit points as described in the illustrative embodiments. Typical examples of the determination unit configured to decrease hit points of an enemy character and at least one of the first and second characters and to determine a winner based on respective remaining amount of the hit points may be, but are not limited to, a win/lose determination unit 167 configured to calculate the damage (reduction in hit points) of each character in accordance with the battle action of the player character, and to decide the winner based on the remaining amount of hit points as described in the illustrative embodiments.

In some cases, the first setting unit may be configured to set the second character for a second game player different from the first player.

In some cases, at least parts of the slot reels are associated with the first and second characters respectively. The decision unit may be configured to decide the battle action of the first group, on the basis of a symbol to be stopped at the stop position and on the basis of the parameter of an associated one of the first and second characters with the associated one of the slot reels of the first and second reel groups.

In some cases, the lottery unit may be configured to decide a probability that a symbol of one of the slot reels of the first reel group is stopped at the stop position, on the basis of a parameter of at least one of the first and second characters belonging to the first group.

In some cases, the decision unit may be configured to decide the battle action of the first group, on the basis of a symbol to be stopped at the stop position and on the basis of the parameter of an associated one of the first and second characters with the associated one of the slot reels of the first and second reel groups. In this case, the lottery unit may be configured to decide a probability that a symbol of one of the slot reels of the first reel group is stopped at the stop position, on the basis of a parameter of an associated one of the first and second characters belonging to the first group with the slot reel.

In some cases, the decision unit may be configured to decide the battle action of the first group, on the basis of a symbol to be stopped at the stop position and on the basis of the parameter of an associated one of the first and second characters with the associated one of the slot reels of the first and second reel groups. In this case, the lottery unit may be configured to decide probabilities that symbols of all of the slot reels of the first reel group are stopped at the stop positions, on the basis of parameters of the first and second characters belonging to the first group.

In some cases, the decision unit may be configured to decide the battle action of the first group, on the basis of a symbol to be stopped at the stop position and on the basis of the parameter of an associated one of the first and second characters with the associated one of the slot reels of the first and second reel groups. In this case, the lottery unit may be configured to decide a probability that a symbol of each of the slot reels of the first reel group is stopped at the stop position, on the basis of a parameter of an associated one of the first and second characters with the slot reel.

In some cases, the game device may further include, but is not limited to, a control unit configured to vary parameters of characters, including the first character, on the basis of a result of the game played by at least the first player, the characters having been set by the setting unit for the first player and for a second player. Typical examples of the control unit configured to vary parameters of characters may be, but are not limited to, a game progression control unit 30 as described in the illustrative embodiments. Typical examples of the control unit configured to vary parameters of characters may be, but are not limited to, a game progression control unit 160 configured to perform overall control of the game provided in the terminal 100A, based on the player operations interpreted by the operation interpreting unit 161, and to generate internal parameters having the same content as the game parameters as described in the illustrative embodiments.

In some cases, the first setting unit may be configured to set the second character for a second game player different from the first player. In this case, the game device may further include, but is not limited to, a control unit configured to vary a parameter of the second character for the second player, on the basis of a result of the game played by the second player. Typical examples of the control unit configured to vary parameters of characters may be, but are not limited to, a game progression control unit 30 as described in the illustrative embodiments. Typical examples of the control unit configured to vary parameters of characters may be, but are not limited to, a game progression control unit 160 configured to perform overall control of the game provided in the terminal 100A, based on the player operations interpreted by the operation interpreting unit 161, and to generate internal parameters having the same content as the game parameters as described in the illustrative embodiments.

In some cases, the game device may further include, but is not limited to, a second setting unit configured to set each character belonging to any one of a plurality of second groups. In this case, the first setting unit may be configured to set a character belonging to the same second group to which the first character also belongs, as the second character belonging to the first group. In this case, the second setting unit may be configured to accumulate points acquired reflecting results of the game for each of the plurality of second groups, and to make the display device display the results of accumulation. Typical examples of the second setting unit may be, but are not limited to, a second group management unit 80 configured to add to the character data 22 information indicating that the character of each player belongs to which group of a plurality of second groups and to accumulate the points acquired reflecting the results of the game, for each second group, as described in the illustrative embodiments.

In some cases, the lottery unit may be configured to decide a stop position of the slot reel that is still spinning, while one or more other reels specified by the first player are stopped at the stop positions having been decided by the lottery unit.

In some cases, the decision unit may be configured to decide the battle action of the first group while a symbol on a slot reel is changed to be a special symbol that substitutes for any other symbols.

In some cases, symbols on the slot reel include at least a main-symbol and at least a sub-symbol. In this case, the decision unit may be configured to decide the battle action of the first group on the basis of the main-symbol to be stopped at a predetermined position and of the sub-symbol to be stopped at the predetermined position.

In other aspects of the present invention, a computer-implemented game control method may include, but is not limited to, the following processes. The method may include a process for setting a first character for a first player and a second character different from the first character, both the first and second characters belonging to a first group. The method may also include a process for deciding stop positions of spinning slot reels of a reel group displayed on a display. The method may also include a process for deciding a battle action of the first group, with reference to the stop positions of the spinning slot reels of the first reel group decided, and on the basis of symbols to be stopped at the stop positions and on the basis of parameters of the first and second characters. The method may also include a process for decreasing hit points of an enemy character in response to the battle action of the first group decided. The method may also include a process for decreasing hit points of at least one of the first and second characters belonging to the first group in response to another battle action by the enemy character. The method may also include a process for determining a winner based on respective remaining amount of the hit points of the at least one of the first and second characters and the enemy character.

In some cases, the game control method may be performed by plural computing devices such as terminals and a server computer, which are operatively coupled to each other via any available connection such as any available network. In some cases, the game control method may be performed by a single computing device such as a terminal. The terminal may be any game device which is configured to be dedicated to a game machine or a communication terminal which is configured to communicate through any network to a server computer and which is not dedicated as a gaming device. In those configurations mentioned above, each computer, a terminal or a server computer may be implemented by a storage storing a computer readable program and a processor to execute the program to perform the game control method.

A typical example of the process for deciding stop positions of spinning slot reels displayed on a display may be, but is not limited to, the slot lottery process of step S300 or the slot lottery process of step S412, described in the illustrative embodiments. A typical example of the process for deciding a battle action of the first group may be, but is not limited to, the battle action decision process of step S302 or the battle action decision process of step S414, described in the illustrative embodiments. A typical example of the process for decreasing hit points of an enemy character and hit points of at least one of the first and second characters belonging to the first group may be, but is not limited to, the character hit point decreasing process of step S304 or the character hit point decreasing process of step S416, described in the illustrative embodiments. A typical example of the process for determining a winner may be, but is not limited to, the character hit point determination process of step S306 or the character hit point determination process of step S422, described in the illustrative embodiments.

In other aspects of the present invention, a non-transitory computer readable medium stores a computer program to be executed by a computer to perform a game control method. The method may include, but is not limited to, the following processes. The method may include a process for setting a first character for a first player and a second character different from the first character, both the first and second characters belonging to a first group. The method may also include a process for deciding stop positions of spinning slot reels displayed on a display. The method may also include a process for deciding a battle action of the first group, with reference to the stop positions of the spinning slot reels of the first reel group decided, and on the basis of symbols to be stopped at the stop positions and on the basis of parameters of the first and second characters. The method may also include a process for decreasing hit points of an enemy character in response to the battle action of the first group decided. The method may also include a process for decreasing hit points of at least one of the first and second characters belonging to the first group in response to another battle action by the enemy character. The method may also include a process for determining a winner based on respective remaining amount of the hit points of the at least one of the first and second characters and the enemy character.

In some cases, the game control method may be performed by plural computing devices such as terminals and a server computer, which are operatively coupled to each other via any available connection such as any available network. In some cases, the game control method may be performed by a single computing device such as a terminal. The terminal may be any game device which is configured to be dedicated to a game machine or a communication terminal which is configured to communicate through any network to a server computer and which is not dedicated as a gaming device. In those configurations mentioned above, each computer, a terminal or a server computer may be implemented by a storage storing a computer readable program and a processor to execute the program to perform the game control method.

A typical example of the process for deciding stop positions of spinning slot reels displayed on a display may be, but is not limited to, the slot lottery process of step S300 or the slot lottery process of step S412, described in the illustrative embodiments. A typical example of the process for deciding a battle action of the first group may be, but is not limited to, the battle action decision process of step S302 or the battle action decision process of step S414, described in the illustrative embodiments. A typical example of the process for decreasing hit points of an enemy character and hit points of at least one of the first and second characters belonging to the first group may be, but is not limited to, the character hit point decreasing process of step S304 or the character hit point decreasing process of step S416, described in the illustrative embodiments. A typical example of the process for determining a winner may be, but is not limited to, the character hit point determination process of step S306 or the character hit points determination process of step S422, described in the illustrative embodiments.

The term "computer readable recording medium" as used herein refers to any non-transitory tangible medium. Typical examples of the computer readable recording medium may include, but are not limited to, a removable medium such as a flexible disc, an optical disk, an optomagnetic disk, a ROM, a CD-ROM, or the like, or a storage device such as a hard disk drive or the like that is built into a computer system. Typical examples of the computer readable recording medium may also include one that dynamically holds a program for a given period of time, such as various devices included in a communication system that transmits a program via a network such as the Internet or by a communication circuit such as a telephone line, and also a device that holds a program for a certain time, such as a volatile memory of a computer system that functions as a server or client in that case.

The above-mentioned program may implement a part of the above-described functions, and further may implement the above-described functions in combination with a program already stored in a computer system.

The term "configured" is used to describe a component, section or part of a device includes hardware alone or in combination with software that is constructed and/or programmed to carry out the desired function.

It is apparent that the present invention is not limited to the above embodiments, but may be modified and changed without departing from the scope and spirit of the invention.

What is claimed is:

1. A game device comprising:

a software component;

a memory that stores the software component;

a hardware processor configured to read the software component out of the memory and execute the software component to perform at least:

setting a first character for a first player and a second character different from the first character, both the first and second characters belonging to a first group;

varying parameters of the first and second characters based on a first result of a game played by the first player and of a second result of the game played by a second player different from the first player;

deciding a probability that a symbol of each of a plurality of spinning slot reels of a first reel group is stopped at a stop position, based on a parameter of an associated one of the first and second characters belonging to the first group with each slot reel;

deciding a battle action of the first group, with reference to the stop positions of the spinning slot reels of a first reel group, and based on symbols to be stopped at the stop positions and based on at least both parameters of the first and second characters, and deciding the battle action of the first group, based on a symbol to be stopped at the stop position and based on the parameter of the first and second characters, the slot reels of the first reel group being associated with the first and second characters, respectively; and decreasing hit points of an enemy character in response to the battle action of the first group, and decreasing hit points of at least one of the first and second characters belonging to the first group in response to another battle action by the enemy character, and determining a winner based on respective remaining amounts of the hit points of the at least one of the first and second characters and the enemy character.

2. The game device according to claim 1, wherein the second character is set for the second player.

3. The game device according to claim 1, wherein the hardware processor is configured to execute the software component to perform further at least:

setting each character belonging to any one of a plurality of second groups, and setting a character belonging to the same second group to which the first character also belongs, as the second character belonging to the first group.

4. The game device according to claim 3, wherein the hardware processor is configured to execute the software component to perform further at least:

accumulating points acquired reflecting results of the game for each of the plurality of second groups, and making a display device display the results of accumulation.

5. The game device according to claim 1, wherein the hardware processor is configured to execute the software component to perform further at least:

deciding a stop position of the slot reel that is still spinning, while one or more other slot reels specified by the first player are stopped at the stop positions having been decided.

6. The game device according to claim 1, wherein the hardware processor is configured to execute the software component to perform further at least:

deciding the battle action of the first group while a symbol on a slot reel of the first reel group is changed to be a special symbol that substitutes for any other symbols.

7. The game device according to claim 1, wherein symbols on a slot reel include at least a main-symbol and at least a sub-symbol, the hardware processor is configured to execute the software component to perform further at least:

deciding the battle action of the first group based on the main-symbol to be stopped at a predetermined position and of the sub-symbol to be stopped at the predetermined position.

8. A computer-implemented game control method performed by a computer, the method comprising:

setting, by the computer, a first character for a first player and a second character different from the first character, both the first and second characters belonging to a first group;

varying parameters of the first and second characters, by the computer, based on a first result of a game played by the first player and of a second result of the game played by the second player different from the first player;

deciding, by the computer, a probability that a symbol of each of spinning slot reels of a first reel group is stopped at a stop position, based on a parameter of an associated one of the first and second characters belonging to the first group with each slot reel;

deciding, by the computer, a battle action of the first group, with reference to the stop positions of the spinning slot reels of the first reel group decided, and based on symbols to be stopped at the stop positions and based on at least both parameters of the first and second characters, and deciding the battle action of the first group, based on a symbol to be stopped at the stop position and based on the parameter of the first and second characters, the slot reels of the first reel group being associated with the first and second characters, respectively;

decreasing, by the computer, hit points of an enemy character in response to the battle action of the first group decided;

decreasing, by the computer, hit points of at least one of the first and second characters belonging to the first group in response to another battle action by the enemy character; and determining, by the computer, a winner based on respective remaining amounts of the hit points of the at least one of the first and second characters and the enemy character.

9. A non-transitory computer readable medium that stores a computer program to be executed by a computer to perform a game control method, the method comprising:

setting a first character for a first player and a second character different from the first character, both the first and second characters belonging to a first group;

varying parameters of the first and second characters based on a first result of a game played by the first player and of a second result of the game played by a second player different from the first player;

deciding a probability that a symbol of each of spinning slot reels of a first reel group is stopped at a stop position, based on a parameter of an associated one of the first and second characters belonging to the first group with each slot reel;

deciding a battle action of the first group, with reference to the stop positions of the spinning slot reels of the first reel group decided, and based on symbols to be stopped at the stop positions and based on at least both parameters of the first and second characters, and deciding the battle action of the first group, based on a symbol to be stopped at the stop position and based on the parameter of the first and second characters, the slot reels of the first reel group being associated with the first and second characters, respectively;

decreasing hit points of an enemy character in response to the battle action of the first group decided;

decreasing hit points of at least one of the first and second characters belonging to the first group in response to another battle action by the enemy character; and determining a winner based on respective remaining amounts of the hit points of the at least one of the first and second characters and the enemy character.

* * * * *